US006830330B2

(12) United States Patent
Suzuki et al.

(10) Patent No.: US 6,830,330 B2
(45) Date of Patent: Dec. 14, 2004

(54) INKS-AND-PRINTING-MEDIA-INTEGRATED PACK, INK-JET PRINTING APPARATUS AND METHOD

(75) Inventors: Mariko Suzuki, Yokohama (JP); Tadayoshi Inamoto, Tokyo (JP); Yoshiaki Kaburagi, Kawasaki (JP); Hiroyuki Saito, Tokyo (JP); Ako Takemura, Saitama (JP); Akira Kuribayashi, Kawasaki (JP); Hiroshi Yoshino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/291,500

(22) Filed: Nov. 12, 2002

(65) Prior Publication Data

US 2003/0058322 A1 Mar. 27, 2003

Related U.S. Application Data

(62) Division of application No. 09/773,496, filed on Feb. 2, 2001, now Pat. No. 6,511,173.

(30) Foreign Application Priority Data

Feb. 3, 2000 (JP) ..... 2000-26113
Feb. 3, 2000 (JP) ..... 2000-26114

(51) Int. Cl.[7] ..... B41J 3/407
(52) U.S. Cl. ..... 347/106; 347/108
(58) Field of Search ..... 347/106, 101, 347/102, 100, 108

(56) References Cited

U.S. PATENT DOCUMENTS

| | | | | |
|---|---|---|---|---|
| 4,460,637 A | | 7/1984 | Miyamoto et al. | 428/212 |
| 5,854,642 A | * | 12/1998 | Takahashi et al. | 347/40 |
| 6,199,976 B1 | | 3/2001 | Sasada | 347/85 |
| 6,200,667 B1 | * | 3/2001 | Haruta et al. | 428/195 |
| 6,217,165 B1 | * | 4/2001 | Silverbrook | 347/86 |
| 6,270,214 B1 | * | 8/2001 | Smith et al. | 347/101 |
| 2001/0033314 A1 | | 10/2001 | Yoshino et al. | 347/86 |

FOREIGN PATENT DOCUMENTS

| | | |
|---|---|---|
| JP | 7-89199 | 4/1995 |
| JP | 7-310037 | 11/1995 |
| JP | 07-310037 | * 11/1995 |
| JP | 8-34942 | 6/1996 |
| JP | 11-11000 | 1/1999 |
| JP | 11-254700 | 9/1999 |

* cited by examiner

*Primary Examiner*—Lamson Nguyen
*Assistant Examiner*—Ly T Tran
(74) *Attorney, Agent, or Firm*—Fitzpatrick, Cella, Harper & Scinto

(57) ABSTRACT

An ink media pack integrally formed with an ink receptacle portion receiving ink and a printing medium receptacle portion receiving a printing medium to be used in an ink-jet printing system is disclosed. In the pack, an optimal combination of ink and a printing medium to obtain a high quality image is housed. In an embodiment the printing medium is cloth and the ink contains dye which can dye the cloth. In another embodiment, the ink has a coloring agent content in a range of 2.0 Wt % to 15.0 Wt % and the printing medium has a bleeding ratio in a range of 2.0 times to 4.0 times.

4 Claims, 21 Drawing Sheets

INKS-AND-PRINTING-MEDIA-INTEGRATED PACK, INK-JET PRINTING APPARATUS AND METHOD

This application is a division of application Ser. No. 09/773,496, filed Feb. 2, 2001, now U.S. Pat. No. 6,511,173.

This application is based on Patent Application Nos. 2000-26113 filed Feb. 3, 2000 and 2000-26114 filed Feb. 3, 2000 in Japan, the content of which is incorporated hereinto by reference.

BACKGROUND OF THE INVENTION

1. Field of the Invention

The present invention relates to an ink-printing medium integrated type pack accommodating ink and a printing medium to be used in an ink-jet printing system, an ink-jet printing apparatus and an ink-jet printing method, in which the integrated type pack can be employed in detachable fashion.

2. Description of the Related Art

The ink jet printing system is carried out by causing fine droplets of inks to fly and adhere to a printing medium such as paper based on various operational principles, to print images, characters, or the like, thereby enabling printing with low noise at a high speed. The ink jet printing system has advantages such as facilitation of multicolor printing and is characterized by a high degree of freedom for recordable patterns, elimination of the necessity of development or fixation, and others. Thus, printing apparatuses based on this system have been rapidly spread in various fields including that of data processing to accommodate various images and print media.

In addition, images formed by means of the multicolor ink jet printing system can easily stand comparison with multicolor printing based on the plate making system or photographic printing based on the color photographing system. The multicolor ink jet printing system enables images to be produced more inexpensively than normal multicolor printing or photographic printing if a small number of copies are particularly to be printed and is thus widely used in the field of full-color image printing.

To accommodate wider applications of the ink jet printing system and enable the recent improvement of printing characteristics such as an increased printing speed, an improved definition, and full color printing, efforts are being made to improve the printing apparatus and method. Characteristics required to achieve wider applications of the ink jet printing system and improve the printing characteristics include, for example, a high density of printed ink dots, bright and clear color tones, fast ink absorption, prevention of outflow or bleeding of inks despite overlapping ink dots, and spread of ink dots with appropriate bleeding.

It is known that these characteristics are realized not only by the printing apparatus and method but also by improving inks or printing media used for printing.

For example, it is known that coated paper is used as a printing medium due to ink absorptivity and fixability achieved thereby. The coated paper comprises, for example, a silicon pigment such as silica, or an absorbing polymer including a resin such as colloidal silica, polyvinyl pyrrolidone, polyvinyl alcohol, polyethylene oxide-isocyanate crosslinked material, or an acrylic polymer having a carboxyl group, or an aluminum-based pigment such as alumina hydrated compound or aluminum oxide, which is each coated on paper, a film, cloth, or the like together with an aqueous binder or the like. On the other hand, inks have their permeability adjusted by means of a surface-active agent or the like contained therein.

To accommodate the improvement of the printing characteristics, however, an optimal combination of printing media and inks which can realize these characteristics is more preferably selected by individually selecting printing media or inks depending on each of the characteristics. This is because the inks and the printing media show each of the characteristics through their mutual relationship.

In this case, to specifically realize the optical combination of the printing media and the inks in an inkjet printing apparatus, configurations and operations are required which replace or install the printing media or the inks depending on a combination of printing media and inks. Additionally, an operation is required for setting printing conditions on, for example, a host computer; for example, a printing mode must be set depending on such a combination. That is, it is cumbersome to carry out the above operations or setting operations each time the combination is switched. It is also difficult for a user to obtain the optimal combination.

In this regard, Japanese Patent Application Laid-open No. Heisei 11-254700 discloses a technology to detachably load a media cartridge, in which a combination of a cassette portion stacking printing media and either an ink tank or a waste ink tank collecting waste ink is integrated, in a printing apparatus. Then, by recognizing the detachably loaded media cartridge in the printing apparatus on the side of the printing apparatus, a printing mode adapting to the printing medium and the ink can be set automatically to permit appropriate printing control adapting to the combination of the printing medium and the ink with a simple operation.

However, in the above-identified publication, while the media cartridge, in which the cassette containing the printing media and the ink tank are integrated, has been disclosed, there is no disclosure for a particular construction of the printing apparatus employing the cartridge in consideration of down-sizing of the printing apparatus and handling of the cartridge.

Also, there is no suggestion for combination of the printing medium and the ink to realize desired printing characteristics in view of material or composition of both of the printing medium and the ink. Namely, in the above-identified publication, when plain paper is set as the printing medium in a plain paper cartridge, setting of the inks is consisted of a treatment liquid, black, yellow magenta and cyan, and, on the other hand, when coated paper, glossy paper, or an OHP sheet, setting of the inks is consisted of the inks similar to the former but excluding the treatment liquid. The reason is that on the coated paper or the like, on which an ink receptacle layer is coated, usage of the treatment liquid making the dye insoluble may degrade image quality. Further, in the above-identified publication, it is disclosed that when a photographic image quality mode is set setting of the inks is consisted of high density black, low density black, high density yellow, low density yellow, high density magenta, low density magenta, high density cyan and low density cyan inks, for example.

As set forth above, in the above-identified publication, there is only disclosed the cartridge, in which combination of inks selected among several kinds of inks easily distinguished by users depending upon the printing medium or the printing mode, are integrated.

On the other hand, from a view pint of dye-affinity, even the printing media appear to be the same, adapted ink compositions should be different if materials or compositions of the printing media are different. In view of this, there are optimal combinations of the printing media and the ink compositions. Particularly, in combination of the paper and the ink, one of important factors significantly influencing for image quality is bleeding of the ink to significantly vary clarity or granular feeding of the image depending upon a degree of bleeding. In this case, it is almost impossible for users to select the combination adapting to the quality of the image desired to form.

Furthermore, as another problem, the most of currently known ink-jet printing apparatuses are more or less inclined to certain characteristics. In such case, it is relatively difficult to satisfy above mentioned various requirements for the printing characteristics.

For example, one of characteristics of the printing head as one factor determining the printing characteristics is a life of a printing head per se. In the case that the printer is used frequently, increasing of durability is desired. Also, as characteristics of the ink, it is desired that residual ink in nozzles in the printing head can be easily removed by recovery operation or the like even after non-use for a relatively long period. It is also desired that composition of the ink can be maintained unchanged so as not to cause change in color. In this circumstance, characteristics of the ink-jet printing apparatus is restricted by the factors set forth above. Therefore, if the ink-jet printing apparatus satisfying all of the characteristics is to be provided, the apparatus inherently becomes bulky and costly. For this reason, manufacturers of the ink-jet printing apparatus or the like, tend to adapt the printing apparatus to some particular characteristics, such as for the user using the printing apparatus frequently, for the user requiring high grade and high quality image, for the user using the printing apparatus under high temperature or low temperature environment and so on, with limiting performance to particular characteristics, and then manufacture and/or sale the printing apparatus adapting to the main trend of demand in the market. If one user possessing an ink-jet printing apparatus having certain characteristics A and wishes it to perform printing which requires another characteristics B, even when a particular mode adapting to the characteristics B is set, there is a limitation for adaptation. Therefore, if the user desires to satisfactorily adapt to the characteristics B, there is no choice but purchasing another printing apparatus provided with the characteristics B.

Particularly, in the case of textile printing for printing on cloth, there is a further problem. Different from printing on paper or a film, the textile printing requires processes of fixing of dye and washing. Therefore, in order not to be washed off the dye in the washing process, it becomes important to perform dying and fixing in a manner of binding where the dye and cloth are matched with each other. However, it is impossible for the user to know the kind of coloring agent contained in the ink from its appearance, possibly causing unmatching in selection of the ink and cloth and resulting in dying failure.

In addition, similar problem to the above should be caused in a relationship between size of particles of a coloring agent in ink and an ink receptacle layer in a printing medium. Namely, when pigment is contained in the ink as a coloring agent and if an average diameter of fine holes in the ink receptacle layer of the printing medium is smaller than an average grain size of the pigment, pigment particles may not be firmly penetrate into the fine holes in the ink receptacle layer to result in lowering of wear resistance of the printed image. However, for the user, it is quite difficult or even impossible to recognize grain size of the pigment particle in the ink or size of the fine holes on the surface of the printing medium. Therefore, it is possible to cause error in selection of optimal combination of the ink and the printing medium.

SUMMARY OF THE INVENTION

The present invention has been worked out for solving the problems set forth above. Therefore, it is an object of the present invention to provide an ink-printing medium integrated type-pack and an ink-jet printing apparatus and ink-jet printing method capable of using the integrated type pack with detachably loading the same, which can realize various printing characteristics with simple construction, and particularly can provide optimal combination of ink and a printing medium to be easily selected by user, and can certainly provide desired quality of image.

In an aspect of the present invention, there is provided an integrated type pack containing ink and a printing medium, wherein the printing medium is cloth and the ink contains dye which can dye the cloth as the printing medium.

Here, the ink may contain reactive dye and the printing medium is cloth to be dyed by covalent bond with the reactive dye.

The ink may contain acid dye or direct dye and the printing medium is cloth to be dyed by hydrogen bond or ionic bond with the acid dye or direct dye.

The ink may contain disperse dye and the printing medium is cloth to be dyed by intermolecular bond with disperse dye.

In another aspect of the present invention, there is provided an integrated type pack containing ink and a printing medium, wherein the ink contains pigment and the printing medium has an ink receptacle layer for receiving the pigment, the ink receptacle layer having fine holes greater than or equal to 50% of which has a diameter greater than an average particle diameter of the pigment.

Here, the ink receptacle layer may have fine holes greater than or equal to 70% of which has a diameter greater than an average particle diameter of the pigment.

The pack may be provided with a stirring means capable of stirring the pigment in the ink.

In a further aspect of the present invention, there is provided an ink-jet printing apparatus detachably loaded the pack as specified above, having a transporting means for transporting the printing medium in the pack, and the ink supplied from the pack being applied to the printing medium by a printing head for performing printing.

The ink may contain reactive dye and the printing medium is cloth to be dyed by covalent bond with the reactive dye.

The ink may contain acid dye or direct dye and the printing medium is cloth to be dyed by hydrogen bond or ionic bond with the acid dye or direct dye.

The ink may contain disperse dye and the printing medium is cloth to be dyed by intermolecular bond with the disperse dye.

The ink receptacle layer may have fine holes greater than or equal to 70% of which has a diameter greater than an average particle diameter of the pigment.

The pack may-be provided with a stirring means capable of stirring the pigment in the ink.

In another aspect of the present invention, there is provided a textile printing method applying the ink supplied from the pack as specified above claimed onto the cloth as the printing medium, and including washing and drying steps performed subsequently after color development process.

Steam may be used in a color development process.

In still another aspect of the present invention, there is provided a pack integrally formed with a printing medium receptacle portion receiving a printing medium and an ink receptacle portion receiving ink, wherein the ink received in the ink receptacle portion has a coloring agent content in a range of 2.0 Wt % to 15.0 Wt %, the printing medium received in the printing medium receptacle portion has a bleeding ratio as printed by the ink in a range of 2.0 times to 4.0 times.

Here, the ink received in the ink receptacle portion may have a coloring agent content in a range of 2.5 Wt % to 12.0 Wt %.

The ink received in the ink receptacle portion may have a coloring agent content in a range of 3.0 Wt % to 10.0 Wt %.

The printing medium received in the printing medium receptacle portion may have a bleeding ratio as printed by the ink in a range of 2.3 times to 3.7 times.

The printing medium received in the printing medium receptacle portion may have a bleeding ratio as printed by the ink in a range of 2.5 times to 3.5 times In another aspect of the present invention, there is provided a pack integrally formed with a printing medium receptacle portion receiving printing medium and an ink receptacle portion receiving ink, wherein the ink received in the ink receptacle portion includes an ink having a coloring agent content in a range of 2.0 Wt % to 15.0 Wt % and an ink containing no coloring agent and having surface tension of 40 mN/m or less at 25° C., the printing medium received in the printing medium receptacle portion has a bleeding ratio as printed by the ink in a range of 2.0 times to 4.0 times.

Here, the ink received in the ink receptacle portion may have a coloring agent content in a range of 2.5 Wt % to 12.0 Wt %.

The ink received in the ink receptacle portion may have a coloring agent content in a range of 3.0 Wt % to 10.0 Wt %.

The printing medium received in the printing medium receptacle portion may have a bleeding ratio as printed by the ink in a range of 2.3 times to 3.7 times.

The printing medium received in the printing medium receptacle portion may have a bleeding ratio as printed by the ink in a range of 2.5 times to 3.5 times.

In another aspect of the present invention, there is provided an ink-jet printing apparatus including a loading portion detachably loading the pack set forth above, comprising:

ink introducing means for introducing an ink from the pack to an ink tank communicated with a printing head; and printing medium feeding means for sequentially feeding the printing medium stored in the pack to a printing position by the printing head one by one.

The printing head may generate a bubble by thermal energy and ejects the ink by the pressure of the bubble.

With the construction set forth above, the ink and the printing medium of optimal combination with respect to a dye-affinity of the ink to the printing medium and a relationship between size of coloring agent of the ink and fine hole diameter in the ink receptacle layer of the printing medium can be packed in the integrated pack. Therefore, even when the user does not recognize optimal combination of the ink and the printing medium in connection with the dye-affinity and fine hole size, printing can be performed with optimal combination in view of printing characteristics when one of the ink or the printing medium can be identified. Also, even when the user cannot identify neither ink nor the printing medium and selects one of the packs, the combination of the ink and the printing medium is still optimal to obtain printing with the quality intended for the selected combination of the ink and the printing medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
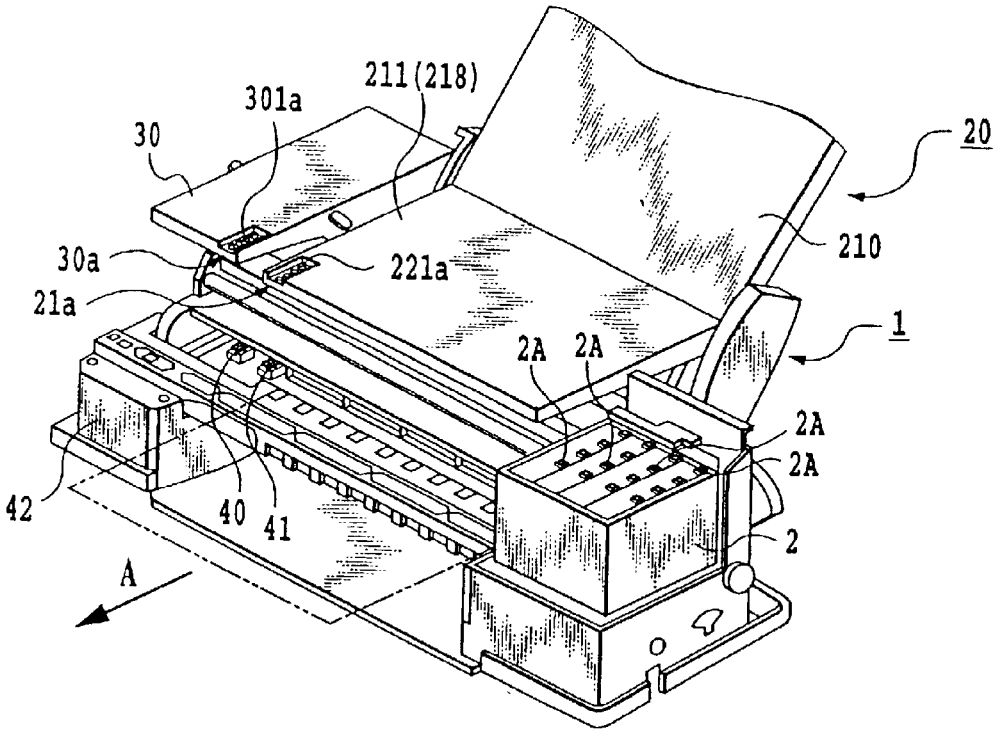
FIG. 1 is a schematic perspective view showing the entire configuration of an ink jet printer according to the present invention.

Embodiments of the present invention will be explained hereinafter with reference to the drawings.

Before explaining constructions of an ink-printing medium integrated pack (hereinafter also referred to as "ink media pack") and an ink-jet printing apparatus, to which the ink media pack is loaded, explanation will be given for one embodiment of a combination of ink and a printing medium to be housed in the ink media pack.

The shown embodiment of the ink media pack receives ink containing a dye capable of coloring at least a printing medium or ink containing at least pigment, and a printing medium having an ink receptacle layer having fine holes having a fine hole diameter greater than a particle diameter of the pigment at a ratio greater than or equal to 70% on the surface. By this, users may easily obtain a desired image without performing particular setting, selection and so on with respect to ink or a printing medium.

Components of ink to be used in the embodiment may be water, water soluble organic solvent, surface active agent, alcohol or the like but is not specifically limited. On the other hand, dye of the ink in the first embodiment may be water soluble dye represented by direct dye, acid dye, basic dye, reactive dye, an edible dyestuff, disperse dye and the like.

Also, material forming cloth to be used in the first embodiment may be cotton, silk, nylon, polyester, wool, rayon, acryl, acetate, polyurethane and so on. These materials form the cloth as sole material or blended materials. On the other hand, the cloth may be pre-processed for improving an ink absorbing ability or preventing bleeding, as required. For example, cloth containing urea, water soluble high polymer, water soluble metal salt and the like is preferred.

In greater detail, as combination of dye to be used in ink and a printing medium in the embodiment, when the printing medium is cloth of cotton or silk, reactive dye is preferred. Also, when the cloth as the printing medium is a composite fabric containing polyester fiber, disperse dye is preferred. In the case of nylon, acid, metallic complex salt, disperse and reactive dyes are preferred. In the case of acryl, acid, basic and disperse dyes are preferred. In the case of polyvinyl alcohol, direct, basic, naphthol and disperse dyes are preferred. In the case of vinylidene and polyvinyl chloride, basic, naphthol and disperse dyes are preferred. Amongst, combinations of polyester fiber and disperse dye, nylon fiber and acid dye or direct dye, and silk or cotton and reactive dye are more preferred. These dyes may be used solely or as mixture as long as coloring effect is not degraded.

In a particular example, disperse dye is a known material per se and is water insoluble azo type, anthraquinone type and other dyes widely used in dyeing of fiber or sublimation transfer technology. These disperse dyes do not have a water soluble radical, such is as a sulfonic group and a carboxyl group and have molecular weight falling within a certain range, and dyes the cloth mainly consisted of synthetic fiber, such as polyester and acetate after application to the fiber or woven cloth or at a temperature in a range of 80° C. to 250° C. during application.

A preferred cloth to be combined with disperse dye may be wove cloth or non-woven fabric consisted of synthetic fiber, such as polyester fiber, acetate fiber, polypropylene fiber, polyvinyl alcohol fiber, and polyamide fiber, or blended yarn fabric or blended yarn non-woven fabric of synthetic fiber and other fiber, such as cotton fiber. As cloth of woven fabric or non-woven fabric, any conventionally known woven or non-woven fabric may be used. In addition, woven fabric or non-woven fabric which is preliminary treated or processed for ink-jet textile printing may also be used. Such preliminary treatment may be performed by applying water soluble or water dispersion type polymer or the like capable of quickly absorbing and holding ink applied on the surface of the fiber forming the woven fabric.

On the other hand, as reactive dye to be used in the embodiment, reactive dye having vinylsulfone group and/or monochlorotriazine group is preferred. The reason why the preferred reactive group is specified is that, in consideration of the ink-jet printing system, in strength of reaction, the foregoing two reactive groups are superior in balance. For example, in the case of dichlorotriazine having high reactivity, there is a tendency that it is difficult to obtain effects. On the other hand, in the case of trichloropyrimidine having low reactivity, there is a tendency that no remarkable effect can be obtained.

As cloth preferred to be dyed using the reactive dye set forth above may be cloth containing cellulose fiber and/or polyamide fiber. By performing textile printing on this cloth by ink-jet printing system, good results can be attained. The cloth contains cellulose fiber and/or polyamide fiber as a major component and is preferred to contain at least alkaline material.

Furthermore, acid dye is soluble to water and has small molar weight among dyes in which dye ions present anionic property, affinity for polyamide fiber, such as nylon, wool or the like, and little affinity for cellulose fiber.

In addition, direct dye is a dye having relatively large molar weight among water soluble anionic dyes and having affinity for cellulose fiber.

For these acid dye and direct dye, preferred cloth is nylon cloth, acryl cloth or the like.

On the other hand, concerning particle diameter of the ink coloring agent and fine hole diameter of the ink receptacle layer, the second embodiment of the printing medium according to the invention may be a paper sheet, a film or the like. It is preferred to contain sizing agent in the paper for lowering general permeability. Surface coating agent of the printing medium is preferably able to control fine hole diameter on the surface by containing casein, cellulose derivative, such as starch or the like, hydrophilic resin having swelling property for the ink, water repellent substance, such as acryl emulsion or the like, sizing agent and conventionally used inorganic pigment or organic pigment. However, surface coating agent is not specifically limited to one set forth above.

An average particle diameter of the pigment as the coloring agent of the ink is in a range of about 70 nm to 200 nm, and an average fine hole diameter of the ink receptacle layer is preferably about 90 nm to 220 nm. When an average fine hole diameter is too small, the pigment cannot penetrate into the ink receptacle layer. On the other hand, if the average fine hole diameter is excessively large, pigment can loose off. On the other hand, the thickness of the ink receptacle layer is preferably not too thick and preferably in a thickness comparable with the fine hole diameter. If the ink receptacle layer is too thick, pigment may be immersed in the ink receptacle layer to cause lowering of printed density to be impractical for use.

The fine hole diameter of the ink receptacle layer set forth above generally has certain distribution. When the fine hole diameter of the portion greater than or equal to 70% of the fine holes in the ink receptacle layer of the printing medium, is greater than the average particle diameter of the pigment contained in the ink, the pigment in an overall image firmly penetrates into the printing medium to obtain a wear resistant image. In contrast to this, if the number of the fine holes having greater diameter than the average particle diameter of the pigment is less than 70%, wear resistance can be lowered. However, if the fine holes having greater diameter than the average particle diameter of the pigment is greater than or equal to 50%, the foregoing effect can be attained in certain extent.

Examples applying some combinations of the ink and the printing medium set forth above to the ink-jet printing apparatus set out with reference to FIG. 1 and subsequent drawings are set forth below.

EXPERIMENTAL EXAMPLE 1

Yellow, magenta, cyan and black inks respectively containing 10 Wt % of reactive dye, 15 Wt % of diethylene glycol, 15 Wt % of thiodiglycol, and 60 Wt % of water, and a cotton broad cloth preliminarily pre-treated by a solution containing 1% of sodium alginate, 3% of saline solution and 2% of sodium hydrogen carbonate were received in the ink media pack to perform predetermined printing. Then, steaming treatment was performed at 102° C. for 8 minutes by a HT steamer, and washing and drying processes were performed. In the printing sample thus obtained, high quality image could be obtained.

EXPERIMENTAL EXAMPLE 2

Yellow, cyan and black inks respectively containing 3 Wt % of direct dye, 15 Wt % of diethylene glycol, 15 Wt % of thiodiglycol, and 67 Wt % of water, and a magenta ink containing 3 Wt % of acid dye, 15 Wt % of diethylene glycol, 15 Wt % of thiodiglycol, and 67 Wt % of water, and nylon 100% cloth preliminarily pre-treated by a solution of 2% of sodium alginate and 3% of ammonium sulfate were received in the ink media pack to perform predetermined printing. Then, steaming treatment was performed at 102° C. for 30 minutes by a HT steamer, and washing and drying processes were performed. In the printing sample thus obtained, high quality image could be obtained.

EXPERIMENTAL EXAMPLE 3

Yellow, magenta, cyan and black inks respectively containing 2.5 Wt % of disperse dye, 20 Wt % of diethylene glycol, 5 Wt % of thiodiglycol, and 72.5 Wt % of water, and a polyester crepe de chine preliminarily pre-treated by a solution containing 2% of sodium alginate, were received in the ink media pack to perform predetermined printing. Then, steaming treatment was performed at 180° C. for 5 minutes by a HT steamer, and conventional reductive cleaning, washing and drying processes were performed. In the printing sample thus obtained, high quality image could be obtained.

EXPERIMENTAL EXAMPLE 4

Yellow, magenta, cyan and black inks respectively containing 3 Wt % of pigment, 20 Wt % of diethylene glycol, 10 Wt % of thiodiglycol, and 67 Wt % of water, and a printing medium coated with a surface layer having fine holes, greater than or equal to 70% of which have a diameter greater than or equal to 160 nm, were received in the ink media pack to perform printing. Then, resultant image had high wear resistance and was high grade.

At this time, particle diameter of the pigment in the yellow ink was 140 nm, particle diameter of the pigment in the magenta ink was 130 nm, particle diameter of the pigment in the cyan ink was 120 nm, and particle diameter of the pigment in the black ink was 100 nm.

Next, a relationship between content of coloring agent of the ink to be employed in one example of the ink media pack according to the present invention and bleeding ratio of the printing medium will be explained in detail.

After extensive study, it has been found that, by containing the ink of greater than or equal to 3.0 Wt % of content of coloring agent and the printing medium having a bleeding ratio of 2.5 times or more as printed by the foregoing ink in the integrated ink media pack (ink-printing medium integrated type pack), in which the ink and the printing medium were integrated, a desired image can be obtained easily without performing particular setting by the user, and particularly, high image quality can be obtained in a photographic image.

In general, when a given image is printed at a given density, a necessary ink amount becomes smaller at higher concentration of the coloring agent in the ink and thus a volume of the ink to be contained in the pack can be smaller. However, if the concentration of the coloring agent is increased, a problem of plugging of nozzles or degradation of properness of an ink-jet printing apparatus, such as durability of ejection or the like can be encountered. On the other hand, even as an image, dots can be perceptive to give granular feeling.

Therefore, in order to obtain high quality of image with reducing a necessary amount of ink, it becomes necessary to control a bleeding ratio of the ink on the printing medium.

From the foregoing viewpoint, the concentration of the coloring agent density in the ink may be in a range of 2.0 Wt % to 15.0 Wt %, for example, more preferably in a range of 2.5 Wt % to 12.0 Wt %, and further preferably in a range of 3.0 Wt % to 10.0 Wt %.

When the concentration of the coloring agent is less than 2.0 Wt %, effects of reduction in size and weight cannot be obtained and a sufficient printing density cannot be obtained and thus is not preferable. Conversely, when the concentration of the coloring agent is greater than 15 Wt %, it is not preferred for shortcomings set forth above.

As a method for measuring the content of coloring agent, an absorbance method by comparison with a known printing density is suitable, but not specifically limited to. The absorbance method is based on Lambert's Law, for example. In the Lambert's Law, the fact that absorbance is proportional to both of the optical path length and density, and can be expressed by the following expression with taking the light intensity passed through the solvent layer and solution layer in the thickness of d are respectively Io and I, concentration of the solution is c and a proportional constant is α.

$$\mathrm{Log}_{10}(Io/I)=\alpha cd$$

On the other hand, the bleeding ratio of the printing medium has to be controlled in a range of 2.0 to 4.0 times, preferably in a range of 2.3 to 3/7 times, and more preferably in a range of 2.5 to 3.5 times.

If the bleeding ratio is less than 2.0 times, a dot does not spread sufficiently to be visually perceptive to form an image having granular feeding, or to leave white spots to cause a problem of lacking of density while same amount of dye is applied on the printing medium. Conversely, when the bleeding ratio is greater than 4.0 times, a dot spreads excessively to make boundary between adjacent different colors indefinite causing a difficulty in obtaining a high definition image.

Here, a bleeding ratio is a value expressed by a value (dot diameter/droplet diameter) derived by dividing the diameter of the dot formed on the printing surface of the printing medium by the droplet diameter. The greater the bleeding ratio represents the higher possibility of bleeding. The dot diameter can be measured with magnification by a microscope or the like.

Upon calculation of the liquid droplet diameter, for example, a hundred thousands ink droplets are ejected and a consumed ink amount is measured to derive a consumed ink weight per one ink droplet. Then, by dividing the thus obtained ink weight per one ink droplet by specific gravity of the ink, volume of the ink per one ink droplet is calculated. Then, the liquid droplet diameter is derived with assuming that the ink droplet is spherical and by calculating the diameter of the sphere in the calculated volume.

A method for controlling the bleeding ratio is not limited and may be realized by optimizing the solvent composition of the ink and additive or the like. Control of the bleeding ratio may also be realized by optimizing the printing medium itself or the coat layer on the surface of the printing medium. On the other hand, it is also effective that by using the ink not containing the coloring agent and having surface tension of less than 40 mN/m at 25° C. in addition to the ink containing the coloring agent, printing is performed with both inks to control the bleeding ratio. Here, the smaller surface tension of the ink not containing the coloring agent may provide the greater bleeding ratio.

Components of the ink to be employed in the present invention may be water, water soluble organic solvent, surface active agent, alcohol, alkaline soluble resin, basic substance. However, the ink components are not particularly limited to them. Also, as a coloring agent in the ink to be employed in the present invention, water soluble dye represented by is direct dye, acid dye, basic dye, reactive dye, edible dyestuff, disperse dye, pigment and the like may be used.

Furthermore, as a printing medium to be used in the present invention, any of paper, film, cloth and so on may be used. On the other hand, in the printing medium, it is preferred to contain a typical sizing agent. The surface coating agent can preferably control a bleeding ratio by containing casein, cellulose derivative, such as starch, hydrophilic resin having a swelling property to the ink, substances having a water repellent property, such as acryl emulsion, a sizing agent, conventionally used typical inorganic pigment or organic pigment. However, the surface coating agent is not limited to them.

EXPERIMENTAL EXAMPLE 5

Yellow, magenta and cyan inks of 3.0 Wt % of dye concentration. 30 Wt % of diethylene glycol, 0.2 Wt % of Acetylenol EH (tradename: manufactured by Kawaken Fine Chemicals), 66.5 Wt % of water and black ink of 3.5 Wt % of dye concentration, 30 Wt % of diethylene glycol, 0.5 Wt % of Acetylenol EH (tradename: manufactured by Kawaken Fine Chemicals), 66.0 Wt % of water, and coated paper LC-201 (tradename: manufactured by Canon Inc.) for ink-jet printing were received in the ink media pack which will be explained later. By using the ink media pack, a photographic image was printed. Then, a high grade image with no granular feeling and sufficiently high density was obtained. At this time, the bleeding ratio was 2.5 times.

EXPERIMENTAL EXAMPLE 6

Yellow, magenta, cyan and black inks of 10.0 Wt % of dye concentration, 30 Wt % of diethylene glycol, 1.0 Wt % of Acetylenol EH (tradename: manufactured by Kawaken Fine Chemicals), 59.0 Wt % of water and coated paper LC-201 (tradename: manufactured by Canon Inc.) for ink-jet printing were received in the ink media pack which will be explained later. By using the ink media pack, a photographic image was printed. Then, a high grade image with no granular feeling and sufficiently high density was obtained. At this time, the bleeding ratio was 3.0 times.

EXPERIMENTAL EXAMPLE 7

Yellow, magenta, cyan and black inks of 2.0 Wt % of dye concentration, 30 Wt % of diethylene glycol, 0.1 Wt % of Acetylenol EH (tradename: manufactured by Kawaken Fine Chemicals), 67.9 Wt % of water and coated paper HR-101 (tradename: manufactured by Canon Inc.) for ink-jet printing were received in the ink media pack which will be explained later. By using the ink media pack, a photographic image was printed. Then, a high grade image with no granular feeling and sufficiently high density was obtained. At this time, the bleeding ratio was 2.1 times.

EXPERIMENTAL EXAMPLE 8

Yellow, magenta and cyan inks of 12.0 Wt % of dye concentration, 5 Wt % of glycerin, 5 Wt % of triethylene glycol, 5 Wt % of urea, 1.0 Wt % of Acetylenol EH, (tradename: manufactured by Kawaken Fine Chemicals), 5 Wt % of isopropyl alcohol and 67.0 Wt % of water, and black ink of 15.0 Wt % of dye concentration, 5 Wt % of glycerin, 5 Wt % of triethylene glycol, 5 Wt % of urea, 1.0 Wt % of Acetylenol EH (tradename: manufactured by Kawaken Fine Chemicals), 5 Wt % of isopropyl alcohol and 64.0 Wt % of water, and coated paper LC-201 (tradename: manufactured by Canon Inc.) for ink-jet printing were received in the ink media pack which will be explained later. By using the ink media pack, a photographic image was printed. Then, a high grade image with no granular feeling and sufficiently high density was obtained. At this time, the bleeding ratio was 3.5 times.

EXPERIMENTAL EXAMPLE 9

Yellow, magenta and cyan inks of 3.5 Wt % of dye concentration, 5 Wt % of glycerin, 5 Wt % of triethylene glycol, 5 Wt % of urea, and 81.5 Wt % of water, and ink not containing dye of 5 Wt % of glycerin, 5 Wt % of triethylene glycol, 5 Wt % of urea, 5 Wt % of isopropyl alcohol, 0.1 Wt % of Acetylenol EH (tradename: manufactured by Kawaken Fine Chemicals), and 79.8 Wt % of water, and coated paper LC-201 (tradename: manufactured by Canon Inc.) for ink-jet printing were received in the ink media pack which will be explained later. By using the ink media pack, a photographic image was printed. Then, a high grade image with no granular feeling and sufficiently high density was obtained. At this time, the bleeding ratio was 2.7 times.

COMPARATIVE EXAMPLE 1

Yellow, magenta and cyan inks of 3.0 Wt % of dye concentration, 30 Wt % of diethylene glycol and 67.0 Wt % of water and black ink of 3.5 Wt % of dye concentration, 30 Wt % of diethylene glycol, and 66.5 Wt % of water, and coated paper HR-101 (tradename: manufactured by Canon Inc.) for ink-jet printing were received in the ink media pack which will be explained later. By using the ink media pack, a photographic image was printed. Then, granular feeling is significant, and a low density image was obtained. At this time, the bleeding ratio was 1.9 times.

COMPARATIVE EXAMPLE 2

Yellow, magenta, cyan and black inks of 16.0 Wt % of dye concentration, 30 Wt % of diethylene glycol, 1.5 Wt % of Acetylenol EH (tradename: manufactured by Kawaken Fine Chemicals), 5 Wt % of isopropyl alcohol and 47.5 Wt % of water, and coated paper LC-201 (tradename: manufactured by Canon Inc.) for ink-jet printing were received in the ink media pack which will be explained later. By using the ink media pack, a photographic image was printed. Then, a blurred image with no granular feeling was obtained. At this time, the bleeding ratio was 4.2 times.

Embodiments of an ink media pack capable of using the above described combination of ink and printing medium and an ink printing apparatus using same are discussed below.

Figure 2:
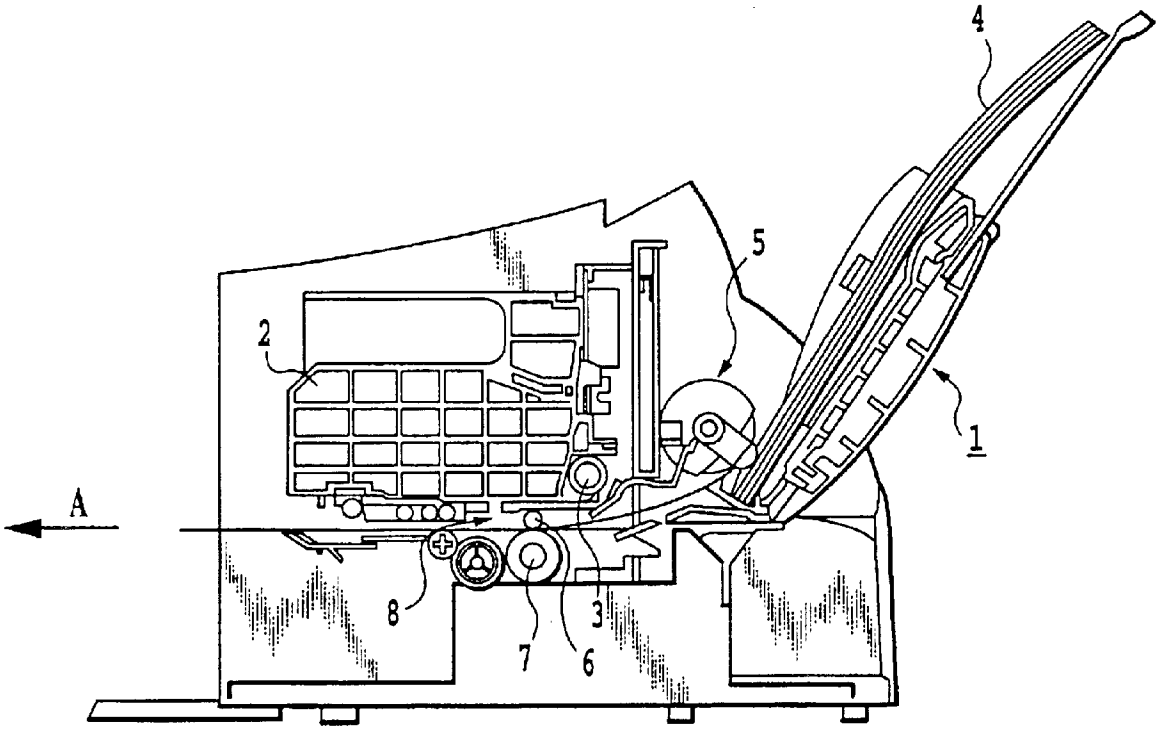
FIG. 2 is a side sectional view showing an integral part of a sheet conveying section of the printer shown in FIG. 1.

FIG. 1 is a schematic perspective view showing an ink jet printer that is one embodiment of a printing apparatus according to the present invention. FIG. 2 is a sectional view of an integral part of the printer shown in FIG. 1, principally showing a sheet feeding mechanism as viewed from a side of the printer.

As shown in FIG. 1, an ink jet printer according to this embodiment can use a pack 20 (hereafter also referred to as an "ink media pack") comprising an ink housing section and a printing media housing section integrated therewith for housing printing media such as paper, the pack being removably installed in the printer. That is, the ink media pack 20 is removably installed in an automatic sheet feeding device (hereafter also simply referred to as an "ASF") 1 installed in the printer main body. When the pack is installed, its printing media housing section 210 lie along the position of the ASF 1, while the ink housing section 211 is separated from the printing media housing section 210 in response to the installation operation as described later and maintains a horizontal position. Printing media housed in the ink media pack 20 are those selected in connection with a small pore or hole diameter of an ink receiving layer or textiles used for textile printing as described above, and are used for relatively special applications. Correspondingly, inks housed in the ink media pack 20 can appropriately dye fine pores or fibrous materials constituting the textiles. In this manner, the ink media pack 20 is used to appropriately combine printing media with inks. To print an image on ordinary paper, paper inks (inks for use on paper) housed in the printer main body are used for the ordinary paper installed in the ASFI.

FIG. 2 shows how the ordinary paper 4 is installed in the ASF 1 in the above case, wherein the paper 4 is directly installed in the ASF 1 with the ink media pack 20 being removed from the printer. Additionally, the inks are housed in a paper ink refilling unit 30 previously installed in the printer main body and arranged in parallel with the ink media pack 20 as installed as shown in FIG. 1, and from which inks for the paper are supplied.

A carriage 2 is provided so as to be movable along a guide shaft 3 (see FIG. 2) provided in such a fashion substantially traversing the printer main body. The carriage 2 has four printing heads (not shown) for ejecting inks, which are mounted thereunder and communicated with sub-tanks (in this embodiment, four) depending on the types of. The printing heads can thus execute scanning by moving in a sheet width direction of printing media conveyed in a printing area 8 (see FIG. 2), while ejecting inks depending on printing information.

The carriage 2 of this embodiment has ink introducing portions 2A at its top. That is, the ink introducing portions 2A are comprised of four such ink introducing portions, each of which is in communication with a corresponding sub-tank (not shown) via an ink and air input port, as described later. The carriage 2 moves with predetermined timings as described later to move the ink introducing portions to a position corresponding to a supply section 21*a* of the ink media pack 20 or a supply section 30*a* of the paper ink refilling unit 30. Additionally, at this corresponding position, an ink ejection port in the printing head also faces a cap 41, or a cap 40 corresponding to the paper. Thus, operations of supplying the ink to the sub-tank for each printing head, replacing the ink, and recovering ejection can be performed as described later.

Specifically, for the ink supply and replacement as set forth above, the carriage 2 moves to cause its ink introducing portion 2A to reach a position corresponding to the supply section 21*a* or 30*a*, and a carriage elevating mechanism (not shown) with a cam rotates the entire carriage 2 using the guide shaft 3 (see FIG. 2) as a rotation axis. An ink leakage preventing member of the ink introducing portion 2A is brought into tight contact with a joint section of the ink housing section of the ink media pack 20 or a joint section of the paper ink refilling unit 30. Subsequently, the cap 41 or 40 elevates to come into abutment with the printing heads or the like mounted under the carriage 2, thereby enabling the ink supplying or replacing operation as discussed later in relation with FIG. 14 and so on.

Still, for the ejection recovering process, of course the carriage elevating mechanism does not operate but the cap 41 or 40 only elevate to come into abutment with the printing heads. In addition, the tight contact between the ink introducing portion 2A and each of the above described joint sections can be canceled by performing an operation reverse to the above described one performed by the carriage elevating mechanism. Furthermore, this operation of a cam in the elevating mechanism is achieved by a driving force of a motor; driving control of the motor for elevating or lowering the carriage is performed. In order to move the carriage 2, driving control of the motor is performed for allowing the cam to retreat to a position where it does not engage with the carriage 2.

Additionally, for the ink supply and replacement as set forth above, a pressure mechanism (not shown) provided in the printer main body and comprising a cam, a push-in pin, and others performs predetermined operations. The operation for the ink supply or replacement is accomplished when the push-in pin engages with a predetermined member of the pressure section 221*a* of the ink media pack 20 or of the pressure section 301*a* of the paper ink refilling unit 30.

Further, a recovery mechanism 42 is provided substantially under the caps 40 and 41. The recovery mechanism 42 comprises a suction pump or the like used for the above described ink supplying and replacing operations and ejection recovering operation.

With the above configuration, during printing, first, a sheet-feeding roller 5 (see FIG. 2) provided in the ASF 1 supplies a printing medium from the ink media pack 20 or directly from the ASF 1 to the printing area 8. Then, as shown in FIG. 2, for each scanning of the printing head installed in the carriage 2, the sheet-feeding roller 7 and the pressure roller 6 cooperate with each other in feeding the printing medium in a direction shown by arrow A in the figure, is by a predetermined amount for each feeding operation, so that images are sequentially printed on a printing surface of the printing medium.

Figure 3:
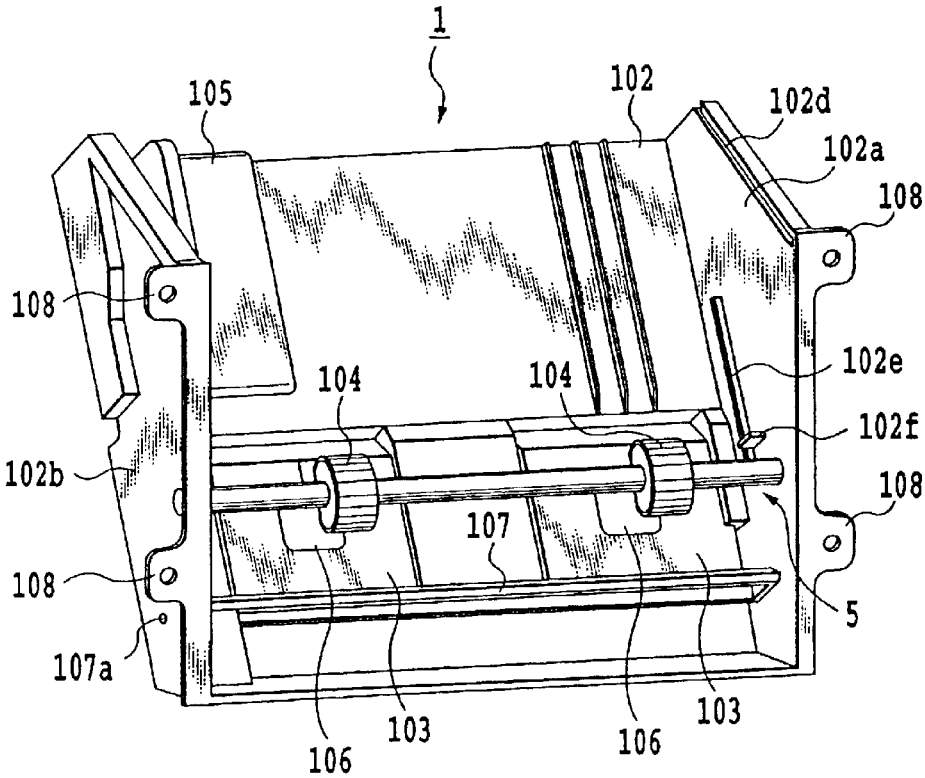
FIG. 3 is a perspective view of an automatic sheet feeding device (ASF) for the printer shown in FIG. 1.

FIG. 3 is a perspective view showing the detailed configuration of the ASF 1.

As shown in this figure, the ASF 1 comprises a base 102, pressure plates 103, a sheet feeding roller unit 5, a movable side guide 105, a leaf spring (not shown), a separating pad 106 and other components (not shown), such as a gear train for transmitting a driving force.

The base 102 is inclined from the printer main body through 30° to 60° to directly support plain or ordinary paper, as it is used. On the other hand, when the printing media housed in the ink media pack 20 are used, the base 102 supports the installed pack itself. A separating surface 107 is provided below the base 102. The separating surface 107 provides a basic function of applying a predetermined resistance to a tip of the plain paper fed by the sheet feeding roller unit 5 when the paper has been directly mounted in the ASF 1, thereby restricting the tip of the plain paper to separate the sheets one by one. The separating surface 107 also provides a function of supporting the lower end of plural stacked sheets of the plain paper.

Further, the separating surface 107 is rotatably supported by a shaft 107*a* and urged upward by a spring (not shown), thereby maintaining a predetermined position for supporting the above mentioned plain paper. On the other hand, when the ink media pack 20 is installed in the ASF 1, the separating surface 107 is pressed by the lower end of the ink media pack 20 in connection with the installation operation as shown in figure and is thus rotated downward against an urging force of the above mentioned spring to recede.

On the flat surface of the base 102, pressure plates 103 are provided on the separating surfaces 107, adjacent to each other. The pressure plate 103 is slidably provided with respect to the base 102 in a orthgonal direction to it, and is urged against the sheet feeding roller unit 5 by a pressure leaf spring (not shown) provided on the back side of the pressure plate 103. In other words, the pressure leaf spring is provided at a position corresponding to a roller 104 of the sheet feeding roller unit 5 on the back side of the pressure plate 103, so that it is possible to bias plain paper or the printing media housed in the ink media pack 20 against the sheet feeding roller unit 5 by a biasing force of the pressure leaf spring.

A side guide 105 is provided so as to slide in a width direction of the plain paper installed on the flat surface portion of the base 102, that is, in the transverse direction in FIG. 3 so that when the plain paper is set in the ASF 1, a width-wise position of the plain paper can be restricted depending on its size. That is, in setting the plain paper in the ASF 1, the width direction of the plain paper can be restricted by using the base right-hand plate 102*a* as a referential plane to abut one side end of the plain paper on the base right-hand plate 102*a*, while abutting the side guide 105 on the other side end of the plain paper.

The sheet feeding roller unit 5 is rotatably supported by a right-hand plate and a left-hand plate 102*b* formed with the base 102 at opposite ends thereof. The sheet feeding roller unit 5 is comprised of a shaft portion supported rotatably and two rollers 104 spaced away from each other at a predetermined interval and integrally formed from a plastic material. Additionally, the roller portion 104 has a roller rubber attached to its outer peripheral surface constituting its circumferential portion, to generate a larger conveying force when the printing media including the plain paper are fed. Specifically, the outer peripheral surface of the roller portion 104 has a generally D-shaped (or half-moon-shaped) cross section. This enables the laminated printing media to be appropriately fed sheet by sheet. In addition, the two roller portions 104 are located on the shaft portion about 40 and 170 mm away from a referential position for the plain paper on the base right-hand plate 102*a* (on the inner surface of the base right-hand plate 102*a*). Accordingly, if printing media such as those of an A4 size which are relatively wide are used, the two rollers 104 are used for sheet feeding. If, for example, those which have a width corresponding to postcards or the like are used, one of the roller portions 104 which is closer to the base right-hand plate 102*a* is used for a sheet feeding operation.

When setting plain paper or an ink media pack, the pressure plate 103 slides in a direction away from the sheet feeding roller unit 5 against the biasing force by means of a cam (not shown). That is, the cam is connected with the sheet feeding roller unit 5 through a drive transmission system (not shown), so that when the pressure plate 103 retreats from the sheet feeding roller unit 5 (in a state of releasing of the pressure plate 103), the roller portion 104 of the sheet feeding roller unit 5 is controlled with respect to a rotational phase such that a straight portion of the D-shaped peripheral (or a chord of the half-moon-shaped) take a position opposite to the pressure plate 103. By this, a constant space is formed between the sheet feeding roller unit 5 and the pressure plate 103 so that it becomes possible to set plain paper or an ink media pack. In addition, the sheet feeding roller unit 5 has a roller sensor (not shown) to detect rotational phases of the roller portions 104 of the sheet feeding roller unit 5 as well as slide positions of the pressure plates 103, moving synchronously with the sheet feeding roller unit 5 by matching their phases with that of the sheet feeding roller unit 5, thereby determining control timings for a sheet feeding sequence for the plain paper 4 and the printing media 200 in the ink media pack 20.

While the plain paper is being fed, predetermined rotations of the above mentioned cams cause the pressure plates 103 to approach the sheet feeding roller unit 5 due to the urging forces of the pressure plate springs. This causes the roller portions 104 of the sheet feeding roller unit 5 to come in abutment with the top surface of the top sheet of the plain paper. As the roller portions 104 are further rotated, frictional force is applied to the plain paper in the sheet feeding direction (downward direction in the figure). At this time, the second sheet of the plain paper from the top and the subsequent sheets undergo a relatively weak frictional force generated between the sheets, the plain paper is hindered from moving in the sheet feeding direction due to resistance from the separating surface 107. Thus, only the top sheet of the plain paper 4 rides on the separating surface 107 and is thus separated from the other sheets; it is then fed beyond the separating surface 107.

Subsequently, the separated and fed plain paper is fed to a printing media feeding section. The sheet feeding roller 5 is rotated until all the plain paper is fed to the printing media feeding section, and the pressure plates 103 then enters the above described initial releasing state relative to the sheet feeding roller unit 5. In this case, the rotational driving forces of the roller portions 104 of the sheet feeding roller unit 5 which are applied to the plain paper are blocked and this state is maintained.

After the paper placed on the pressure plate 103 of the ASF 1 or the paper composed of a synthetic resin or the like has thus been fed by the sheet feeding roller unit 5, the sheet feeding roller 7 (see FIG. 2) conveys the paper to the printing position opposite to the printing head in order to print.

On the pressure plate 103 opposed to the roller portion 104 of the sheet feeding roller unit 5, a separation pad 106 made of a material, such as leatherette, having a relatively high friction coefficient coefficient is provided thereby preventing a plural sheets from being conveyed at a time when the stacked number of plain paper is reduced.

Next, the configuration of the ink media pack 20 removably installed in the ASF 1, described above, will be described.

Figure 4:
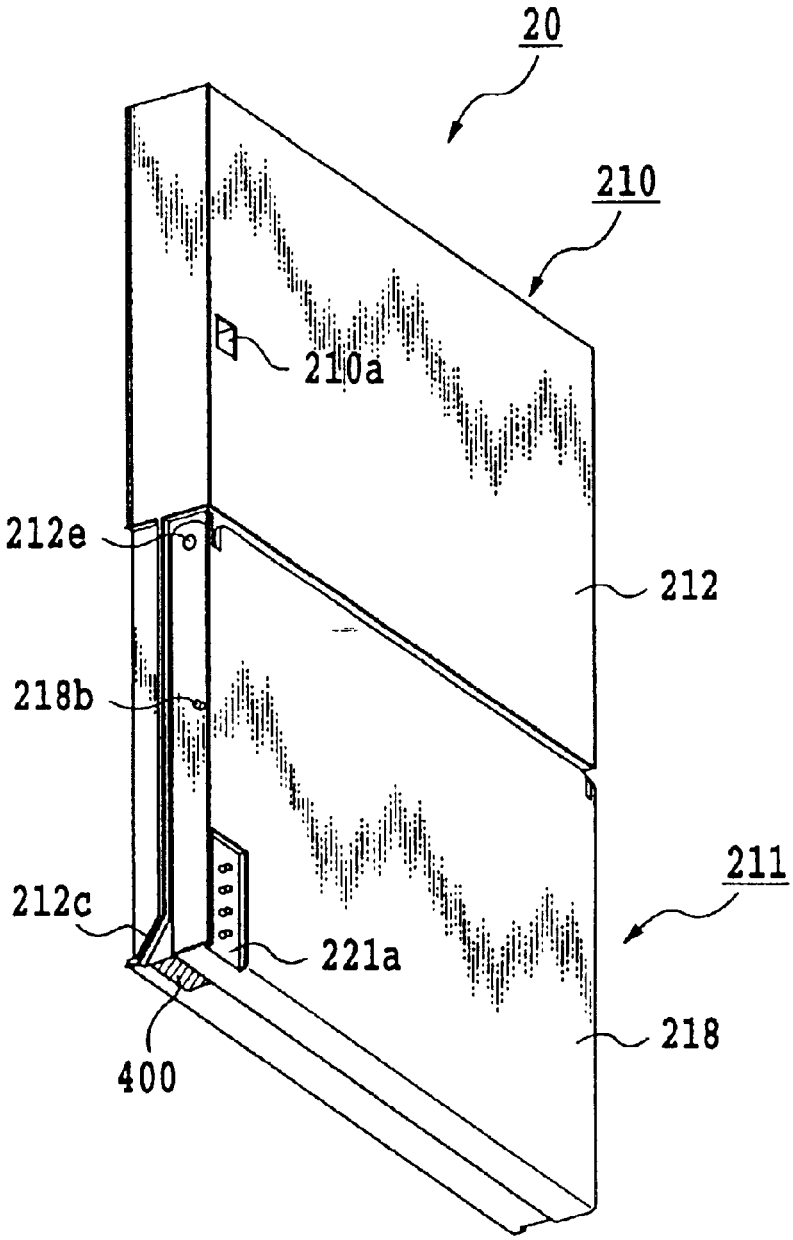
FIG. 4 is a perspective view showing a front appearance of an ink media pack which is detachably used for the printer.
Figure 5:
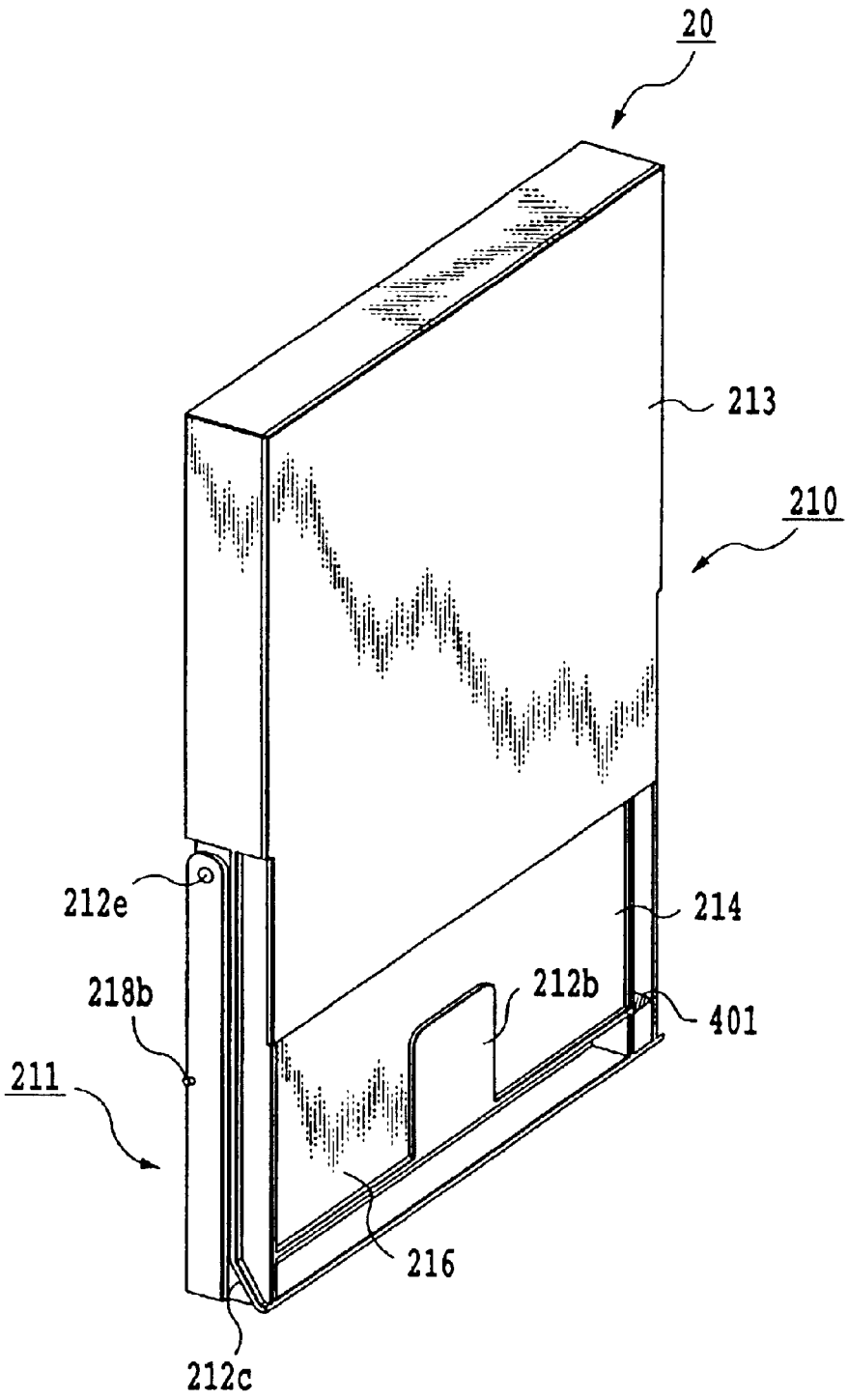
FIG. 5 is a perspective view showing a rear appearance of the ink media pack.
Figure 6:
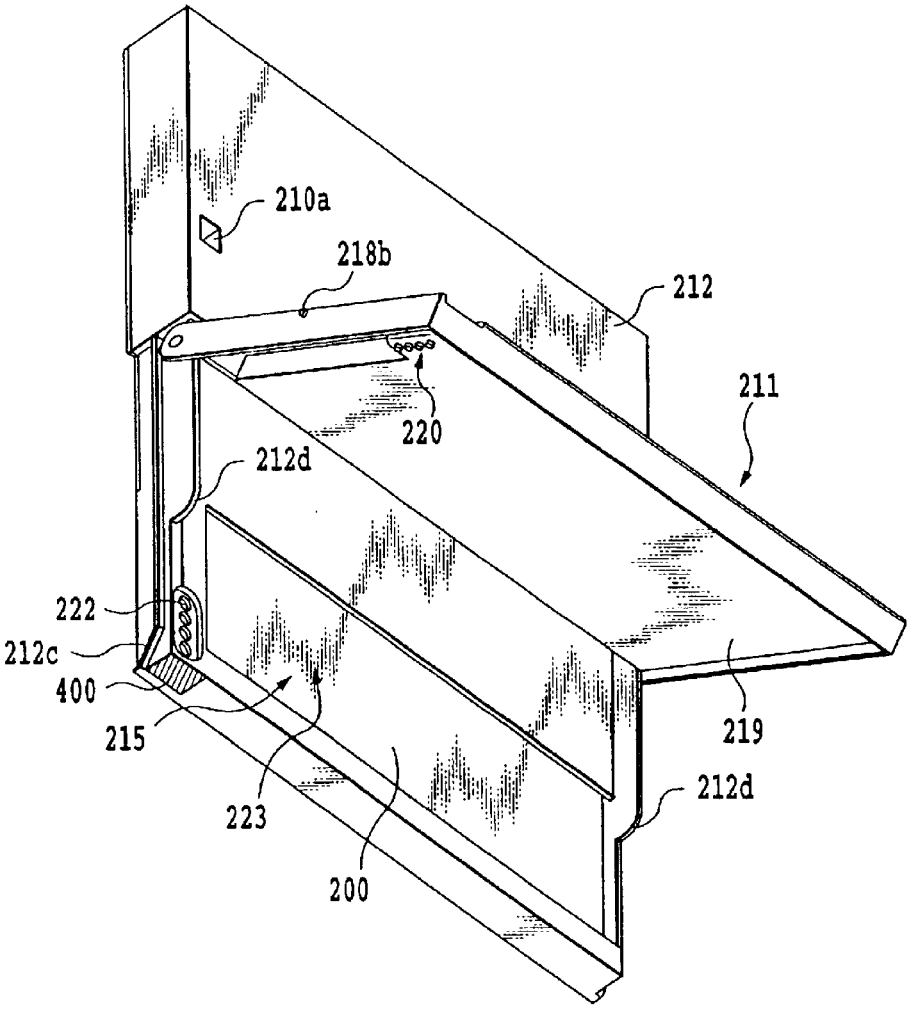
FIG. 6 is a perspective view showing the ink media pack in a state that the ink housing section is opened.

FIGS. 4 to 6 show the configuration of the ink is media pack 20. FIG. 4 is a perspective view of the ink media pack 20 as seen from its front side, FIG. 5 is a perspective view thereof as seen from its rear side, and FIG. 6 is a perspective view showing an ink case forming the ink housing section in its opened state.

The ink media pack 20 houses an optimal combination of printing media and inks corresponding to various printing characteristics and enables the printing mode to be automatically set by means of its installation, as described previously. That is, this embodiment prevents a user from mistakenly determining a combination of printing media and inks in principle if optimal types of inks in terms of the printing characteristics vary with the material or composition of printing media even if the latter appear the same to the user, and also enables a printing mode suitable for the combination of installed printing media and inks to be automatically executed when the user installs the selected ink media pack in the printer.

For example, even if appearances of printing media look same, diameters of fine holes of ink receiving layer can be different In this case, an amount of pigment entering into the fine holes becomes different depending on a diameter of the pigment relative to a diameter of fine holes causing a relatively large difference with respect to fretting property after printing In addition, if textiles are used as the printing media, the optimal inks depending on the type of fibers constituting the textiles vary in respect to dyeing properties As discussed above, from these viewpoints, a combination of printing media and inks combined in an ink media pack is selected.

In FIGS. 4, 5, and 6, the ink media pack 20 generally comprises the printing media housing section 210 and the ink housing section 211, which house printing media and inks of an optimal combination as described above, respectively A plurality of such ink media packs 20 are provided for different combinations so that one of them can be installed in the ASF 1 of the printer depending on a selection by the user.

In this case, when a user can properly select one ink media pack by specifying a kind of printing medium among a plurality of such ink media packs, an ink combined in the selected ink media pack becomes optimal with respect to the specified printing medium on printing characteristics. Even if a user fails to specify a printing medium in selecting an ink media pack, since an optimal ink for the printing medium which has been failed to specify is combined in the selected ink media pack, a result of printing using such ink media pack is ensured to be good.

Figure 7:
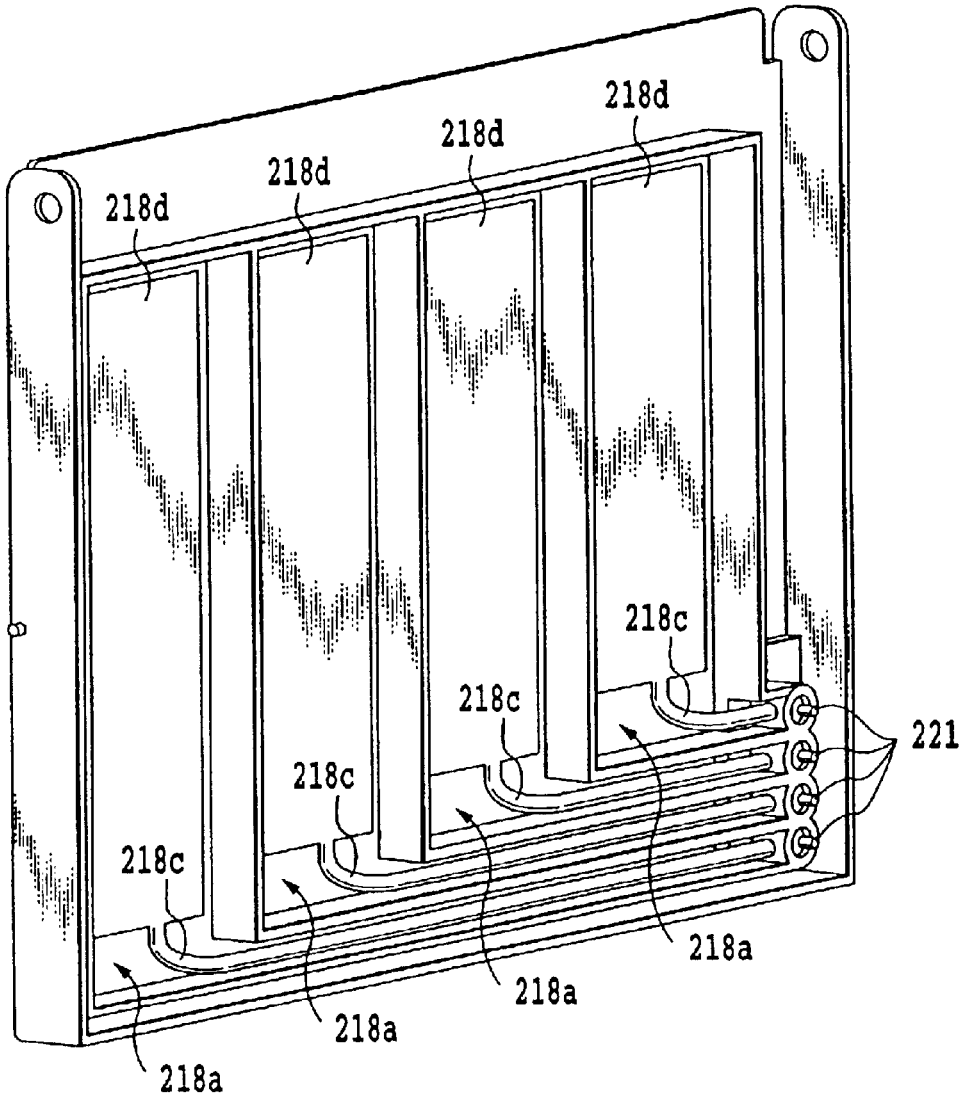
FIG. 7 is a perspective view showing the internal configuration of the ink housing section of the ink media pack.

The ink housing section 211 is structured to be entirely enclosed by an ink case 218. The ink housing section 211 internally has ink chambers each corresponding to one of a plurality of inks housed therein, the chambers each having an ink tube that stores an ink, as will be described in FIG. 7. Additionally, the ink housing section 211, acting as a lid member, is provided so as to be opened and closed relative to the printing media housing section 210 (see FIG. 6). That is, the ink case 218, acting as a lid member, is supported for free rotational movement by means of a rotational shaft 212*e* provided on opposite sides of the printing media housing section 210, so that when the ink media pack 20 is installed in the printer, the ink case 20 moves rotationally in response to the installation operation to occupy a predetermined position (see FIG. 1). The ink case 218 has the pressure section 221*a* (see FIG. 4) in a corner portion on a rectangular top surface thereof, and a joint section 220 (see FIG. 6) on an opposite bottom surface. These sections are used for ink replacement and supply as described later.

On the other hand, the printing media housing section 210 has printing media 200 housed therein and substantially entirely covered by a media case 212 forming a front surface side of the housing section 210 and a rear cover 213 on a rear side thereof. The printing media housing section 210 has an opening formed in a portion of a lower part thereof. That is, the printing media housing section 210 has a front opening 215 formed in a lower portion of the front side as shown in FIG. 6. This chiefly enables the housed printing media 200 to be fed by causing the roller section 104 (see FIG. 3) of the sheet feeding roller unit 5 to contact with a surface of the printing media 200 via the front opening 215. On the other hand, the printing media housing section 210 has, as shown in FIG. 5, a rear opening 216 formed in a rear side. The rear opening 216 chiefly enables the pressure plate 103 of the ASF 1 and the printing media 200 to be engaged with each other when the ink media pack 20 is installed in the ASF 1.

The plurality of printing media stacked and housed in the printing media housing section 210 are housed via the protective sheet 214 on the rear side. The rear opening 216 is also provided with a lock 212*b*. These protective sheet 214 and the lock 212*b* prevent the housed printing media from escaping to the rear side and avoid dust from entering through the rear opening 216. The protective sheet 214 is formed of the same material as the housed printing media so as to have an appropriate friction coefficient for its relationship with the printing media. This restrains a phenomenon where the bottom one of the laminated and housed printing media, that is, the one that is in direct contact with the protective sheet 104 cannot be appropriately fed or a phenomenon where one of the printing media 200 is prematurely fed together with another laminated thereon (overlapping feeding).

Further, the printing media housing section 210 has a connector 400 provided in part of the lower end surface thereof, as shown in FIG. 6, and which is electrically connected to a connector 310 (see FIG. 8) provided an introducing open end of the ASF 1. This enables the printer main body to read out various information stored in a predetermined memory of the ink media pack 20.

Further, a pack separating surface 212*a* (See FIG. 8) is formed in one of the sides of the printing media housing section 210 which define the front opening 215 thereof. In feeding the printing media 200 housed in the ink media pack 20, the pack separating surface 212*a* separates the printing media 200 one by one as with the plain paper 4 as described previously in FIG. 3. Specifically, the pack separating surface 212*a* is formed as a plane on which the lower ends of those of the printing media 200 laminated and housed in the printing media housing section 210 which are near the top printing medium are abutted during their feeding operation, and has an appropriate butting angle for the separation.

In this embodiment, the separating surface 107 shown in FIG. 3 and the separating surface 212*a* set forth above are used as a separating means. The ASF 1 using separating claws as the separating means, however, requires a method for allowing the separating claws of the ASF to recede when the pack is installed, and in this case, the printing media housing section may have another separating claw or a totally different separating means. The separating means is not limited to the separating surfaces set forth above for both the ASF 1 and the inks and printing media pack, but a combination of optimal separating means can be employed.

Figure 8:
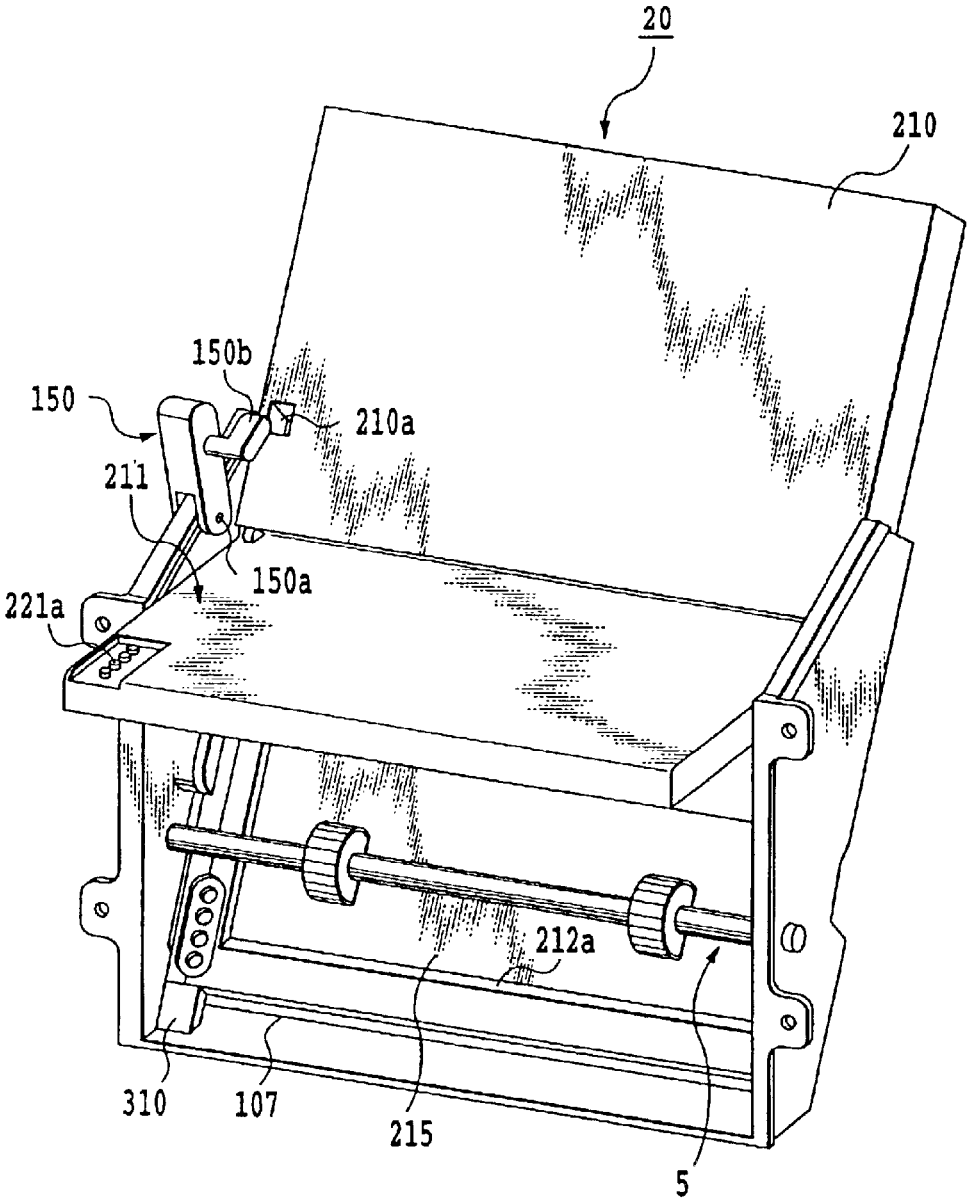
FIG. 8 is a perspective view showing how the ink media pack is installed in the automatic sheet feeding device.

FIG. 8 is a view showing the internal structure of the ink housing section 211, wherein the ink case cover 219 (see FIG. 9) of the ink case 218 constituting the ink housing section 211 has been removed.

The ink case 218 has four ink chambers 218*a* formed inside depending on the colors of inks used for printing. The four ink chambers 218*a* store, for example, a yellow, cyan, magenta, and black inks by means of ink bags. Of course, appropriate inks may be stored depending on the conditions of printing and the embodiment is not limited to the above inks. Each of the ink chambers 218*a* has an ink bag 218*d* arranged therein. The ink bag is formed of a flexible material and is partly bonded to a bottom surface of the ink chamber for fixation. The ink can be supplied from each of the ink bags 218*d* by connecting an ink supply tube 218*c* attached to one end of the ink bag 218*d*, to each corresponding joint valve 221. The joint valve 221 is in communication with the joint section 220, shown in FIG. 6, so that the carriage moves to dispose its ink supply port opposite to this joint section to be in a state of abling the ink to be supplied to the printing head, as described previously in FIG. 1.

Further, a thin plate magnetic member is integrally attached to the ink bag 218*d* at a back the thereof. Each of the ink bags 218*d* is fixed to a bottom of the ink chamber at an end closer to ink supply tube 218*c*. By this, a fixation of the ink bag to the ink chamber is carried out making a rotation of the ink bag about a supporting portion of the fixation possible. As a result, a magnetic field of an electric magnet provided on a part of carrtridge 2 effects on the magnetic member allowing the ink bag to swing upward and downward with respect to the supporting portion in response to the movement of the carrtridge 2 under the ink housing portion 211. As a result, it becomes possible to properly agitate ink especially in the case that disperce dye or pigment is used as a coloring agent, thereby preventing the disperce dye or pigment from settling and a proper concentration of ink can always be supplied.

A structure for agitating is not limited to the above one. For example, it may be possible to provide a super sonic vibrator in each ink chamber or to provide an agitator element in the ink bag.

As described above, when the ink media pack 20 of the configuration shown in FIGS. 4 to 7 is not installed in the printer, the ink housing section 211 of the ink media pack 20 is closed relative to the printing media housing section 210 to allow the ink housing section 211 to function as a lid for the printing media housing section 210. That is, the ink housing section 211 prevents the printing media 200 housed via the front opening 215 of the printing media housing section 210 from being exposed to air.

Furthermore, a plurality of rubber caps 222 are provided at a position adjacent to the front opening 215 of the printing media housing section 210 and corresponding to the joint section 220 of the ink housing section 211. Thus, when the ink housing section 211 is closed relative to the printing media housing section 210, the rubber caps 222 encloses the joint section 220 to prevent the ink from leaking from the ink bag in each ink chamber 218*a*.

On the other hand, when the ink media pack 20 is installed in the ASF 1 of the printer, the ink housing section 211 is open relative to the printing media housing section 210 (see FIG. 1). That is, the ink housing section 211 is supported for free rotational movement by means of the rotational shaft 212*e* so as to be automatically opened relative to the printing media housing section 211 with installation operation, thereby enabling the ink to be supplied to the above described printing head.

Although in this embodiment, the inks optimally combined with the printing media are housed in the ink housing section, otherwise, washing ink may be housed therein to wash the printing head and the interior of an ink supply passage to the printing head when the ink is replaced. Additionally, if an ejection energy generating element for the printing head comprises an electrothermal converter and if the inks optimal for the printing media may scorch the electrothermal converter, scorch-removing liquid or kogation-removing liquid may be housed which removes kogation from the electrothermal converter.

Next, an operation of installing the ink media pack 20 in the ASF 1 will be described principally with reference to FIGS. 3 to 6.

The ink media pack 20 is configured so as to be installed in and removed from the ASF 1 of the ink jet printer, and configurations required for the installation and removal are provided in the ASF 1 and the ink media pack 20.

In the ASF 1 shown in FIG. 3, introduction guides 102*e* are provided on the base right-hand plate 102*a* and the base left-hand plate 102*b*, respectively. The introduction guides 102*e* engage with the corresponding guide ribs 212*c* provided at the opposite ends of the printing media housing section of the ink media pack 20 when the latter is installed, thereby allowing the operation of installing the ink media pack 20 to be guided. That is, the guide ribs 212*c* of the ink media pack 20 guide the printing media housing section 210 into the ASF 1. The guide ribs 212*c* engage with the corresponding introduction guides 102*e* and slide along them to enable the installation of the printing media housing section 210 to be guided. The guide ribs 212*c* continue sliding until the butting ribs 212*d* (see FIG. 6) formed at the opposite side portions of the printing media housing section 210 butt against the stoppers 102*f* (see FIG. 6) provided on the base right-handplate 102*a* and the base left-handplate 102*b*. This determines a position of the printing media housing section 210 relative to the base 102 for installation and arrangement.

When the above described printing media housing section 210 is installed, the connector 310 (see FIG. 8) for the printer provided in the ASF 1 and the connector 400 provided on the lower end surface of the printing media housing section 210 are connected together, thereby allowing the printer to recognize that the ink media pack 20 has been installed. In addition, after this installation, the ink media pack 20 can be fixed to the ASF 1 by rotating a lock lever 150 in the direction shown by the arrow, the lock lever 150 being provided on the left-hand plate 102*b* of the ASF 1 and supported for free rotational movement by means of a lever shaft 150*a*, so that a projection 150*b* of the lever 150 is inserted into a lock hole 210*a* formed in the ink media pack 210. This fixation enables the above described connectors to be reliably connected together.

The input guide 102*e* is configured to leave a gap between itself and the uppermost sheet of paper during maximum stacking so that when the paper is directly mounted in the ASF 1, an operation of loading or feeding the paper will not be obstructed. When the side guide 105 is moved to the leftmost position in FIG. 3, it is housed in a side guide housing section (not shown) provided on the base left-hand plate 102*b*.

On the other hand, the operation of installing the ink housing section 211 of the ink media pack 20 is guided through the engagement between the guide grooves 102*d* formed in the base right and left hand plates 102*a* and 102*b* of the ASF 1 and guide bosses 218*b* provided on the opposite side portions of the ink case 218 of the ink housing section. That is, during the above described operation of installing the printing media housing section 210, the two guide bosses 218*b* of the ink housing section 211 are engaged with the open ends of the two corresponding guide grooves 102*d* of the ASF 1 before sliding. Then, in response to the above described operation of inserting the printing media housing section 210, the ink housing section 211 start to be opened as the guide bosses 218*b* are guided, and are automatically rotated around the rotating shaft 212*e*. Once the insertion operation has been ended, the ink housing section 211 assumes a substantially horizontal determined position, shown in FIG. 1, to complete the installation.

FIG. 8 is a view showing how the ink media pack 20 is installed in the ASF 1 by means of the above described installation operation.

As shown in this figure, in the installed state, the ink housing section 211 is open relative to the printing media housing section 210 and the front opening 215 of the printing media housing section 210 is opposite to the roller section 104 of the sheet feeding roller unit 5. Additionally, in this state, the rear opening 216 is opposite to the pressure plate 103. That is, since the opening area of the rear opening 216 is larger than that of the pressure plate 103, when the pressure plate 103 enters a pressing state, it presses the rear surface of the housed printing media 200 via the protective sheet 214, thereby enabling the surface of the housed printing media 200 to be contacted the roller section 104 compressibly without displacing the ink media pack 20.

The ink housing section 211 is guided as described previously and then held in a substantially horizontal direction, so that a tip portion of the ink housing section 211 which includes the joint section 220 and the pressure section 221*a* can assume a position for entering the ink jet printer main body. That is, the tip portion can be located above a moving range of the carrier 2. Furthermore, as described later, a cam mechanism (not shown) provided in the printer main body presses the pressure section 221*a*, to activate the joint section 220 to thereby enable the ink to be supplied via the ink supply port 2A on the carriage 2.

For removing the ink media pack 20 from the ASF 1, the above described operation is reversed.

Figure 9:
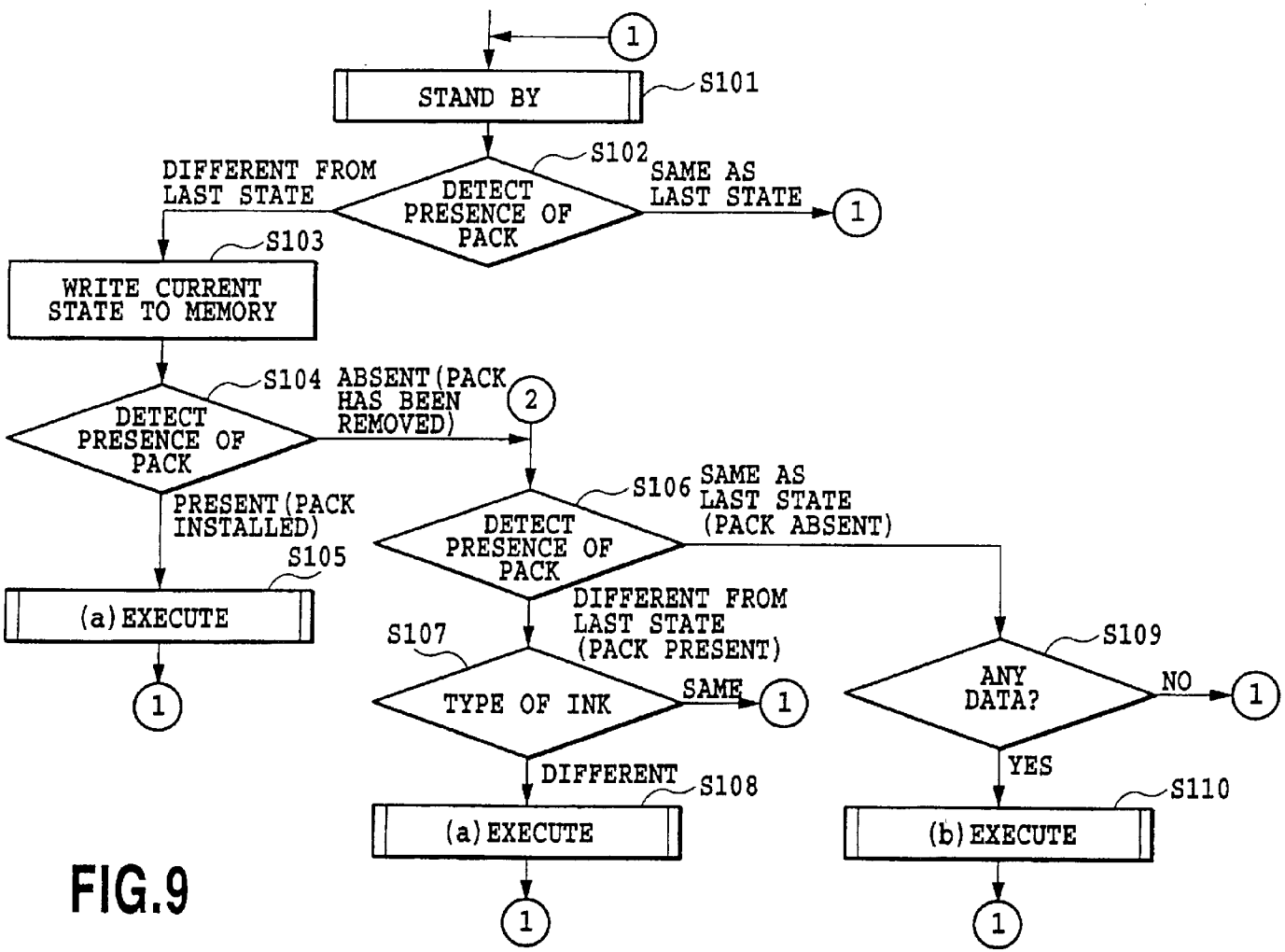
FIG. 9 is a flow chart explaining a process executed with respect to an ink exchange and so on in the case that the ink media pack is attached or detached in a state that the printer is waiting for printing.
Figure 10A:
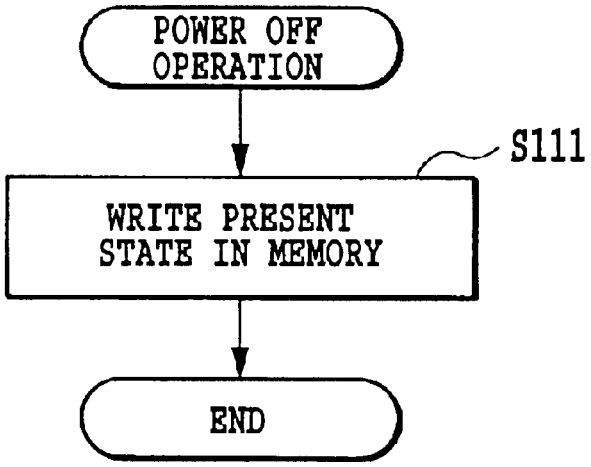
FIG. 10A and FIG. 10B are flow charts explaining a process executed with respect to an ink exchange and so on in waiting for printing in the case that the ink media pack is attached or detached in a state that the printer is turned off.
Figure 10B:
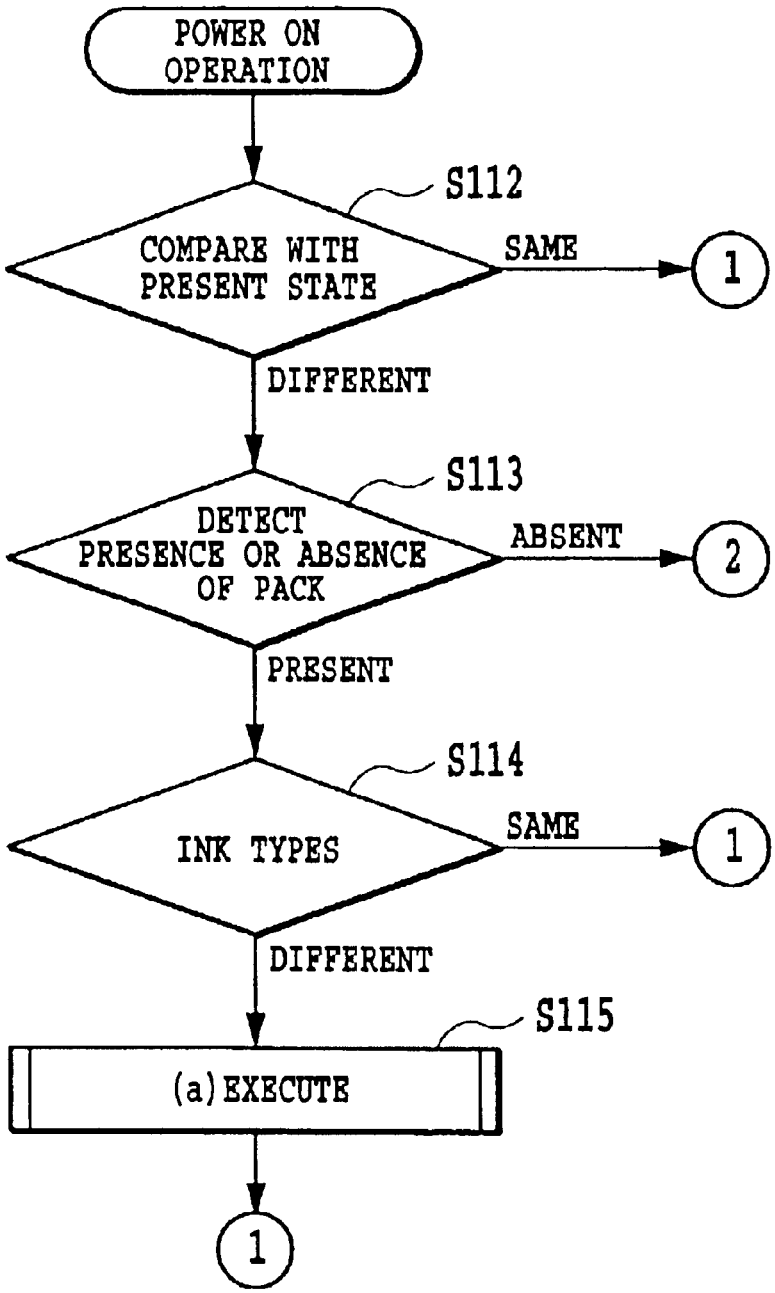

FIGS. 9 and 10 are flow charts showing processes executed by the printer in connection with the installation of the above described ink media pack 20 or the like. FIG. 9 shows a process executed when the installation of the ink media pack 20 or the like is carried out while the power to the printer is on. FIGS. 10A and 10B show a process procedure executed when the installation of the ink media pack 20 or the like is carried out while the power to the printer is off. These processes can be executed by electrically connecting a connector 400 provided in the ink media pack 20 to the connector 310 of the printer.

As shown in FIG. 9, if the installation of the ink media pack 20 or the like is carried out while the power is on, it is executed as part of a printer printing standby process (step S101). That is, this process is activated at predetermined time intervals during printing standby to first determine whether or not the ink media pack 20 has been installed in the printer (S102). This determination process is executed using data of on-installation/non-installation which are written to a predetermined memory of the printer together with data such as the ID of the ink media pack and the types of the inks and printed media. If it is determined that these data are different from the last ones, the current state, including the ID of the ink media pack 20 (if installed), is written to the above memory (S103). The above memory is then referenced to determine whether or not the ink media pack 20 is currently installed (S104). The determination of the installation/non-installation of the ink media pack 20 may be done based on the state of the switch 315 for detecting the installation.

If it is then determined that the ink media pack 20 is installed, it is determined that the state where the ink media pack 20 is not installed has been changed to the state where it is installed and a process (a), described below, is executed and the standby process at step S101 is continued.

On the other hand, if it is determined at step S104 that the ink media pack 20 has been removed, two cases are possible: ① plain paper has been installed and ② an operation of changing the ink media pack 20 to a different type is being performed. Thus, step S106 and subsequent steps are executed.

That is, to distinguish the cases ① and ② from each other, the presence of the ink media pack 20 and the presence of the printing data are monitored (S106 and S109). When whether or not the ink media pack 20 is present is detected at step S106 and if it is determined that the state is the same as the last one, that is, the ink media pack 20 has been removed and it is further determined that the printing data has been transmitted from the host (S109), then it is determined that plain paper is installed and a process (b), described below, is executed.

In addition, if the presence of the ink media pack is detected at step S106 before the printing data are transmitted, then it is determined that the ink media pack 20 has been installed. It is then determined at step S107 whether or not the types of the inks in the ink media pack are the same as those in the previously installed ink media pack. Then, the process (a) is executed only if the types of the inks are different. If the types of the inks remain unchanged, since the inks in the printing head need not be replaced, the standby process is thus continued.

Next, the process executed when the installation of the ink media pack 20 or the like is carried out while the power of the printer is turned off will be described with reference to FIGS. 10A and 10B.

As shown in FIG. 10A, when a power-off operation is performed, data on the current installation state of the ink media pack 20 is written to the above described memory (S111) and the power is then shut off. The ink media pack 20 may be installed or removed while the power is off.

Then, when a power-on operation is performed, the process shown in FIG. 10B is activated to compare the current installation state of the ink media pack 20 with the installation state written at the above step S111, at step S112. At that time, if the installation state of the ink media pack 20 is the same, the inks in the head need not be replaced and the procedure shifts directly to the standby process shown in FIG. 9 to end the present process.

On the other hand, if the installation state of the ink media pack 20 is different, it is determined whether or not the ink media pack 20 is present (S113). At this time, if the absence of the ink media pack 20 is detected, it is considered that two cases are possible: ① plain paper has been installed and ② the operation of changing the ink media pack 20 to a different type is being performed. Thus, the procedure shifts to the processing at step S106 shown in FIG. 9, as described in FIG. 9.

If the presence of the ink media pack 20 is detected, then the information on the types of the inks in this ink media pack 20 is compared with the information on the ink types written at step S111 (S114). At this time, if the ink types are the same, the inks in the printing head need not be replaced and the procedure shifts to the standby process to end the present process.

On the other hand, if the ink types are different, after the process (a), described below, is executed and the procedure then proceeds to the standby process in order to replace the inks in the printing head.

Next, the processes (a) and (b) set forth above will be explained mainly with reference to FIG. 1.

Process (a)

This process is executed if the ink media pack has been replaced with-a different type. First, the carriage 2 moves to the positions of the cap 41 and recovery system 42 for the media pack. While moving for each ink color, the carriage 2 sucks the ink from the printing head side to empty the printing head and the sub-tank and then supplies each color ink at the same ink supply position, as described later. Once each color ink supply has sufficiently finished, the carriage 2 moves to its home position to execute the above mentioned standby process for the printing command.

During the standby process at the above described step S101, when the printing command is issued, a printing medium is fed from the ink media pack 20 and printing is then carried out. After the printing has been completed, the medium is discharged. During the printing, if the ink must be supplied to the sub-tank, then the carriage moves to the ink supplying position to supply each color ink as described above.

Process (b)

This process is executed if paper is directly installed in the ASF 1 and images or the like are printed on the paper. First, the carriage 2 moves to the positions of the cap 40 and recovery system 42 for the paper. While the carriage 2 is moving for each ink color, the ink is sucked from the printing head side to empty the printing head and the sub-tank, and then each color ink is supplied at the same ink supply position, as described later. Once each color ink supply has sufficiently been finished, the carriage 2 moves to its home position to execute the above mentioned standby process for the printing command.

Figure 11:
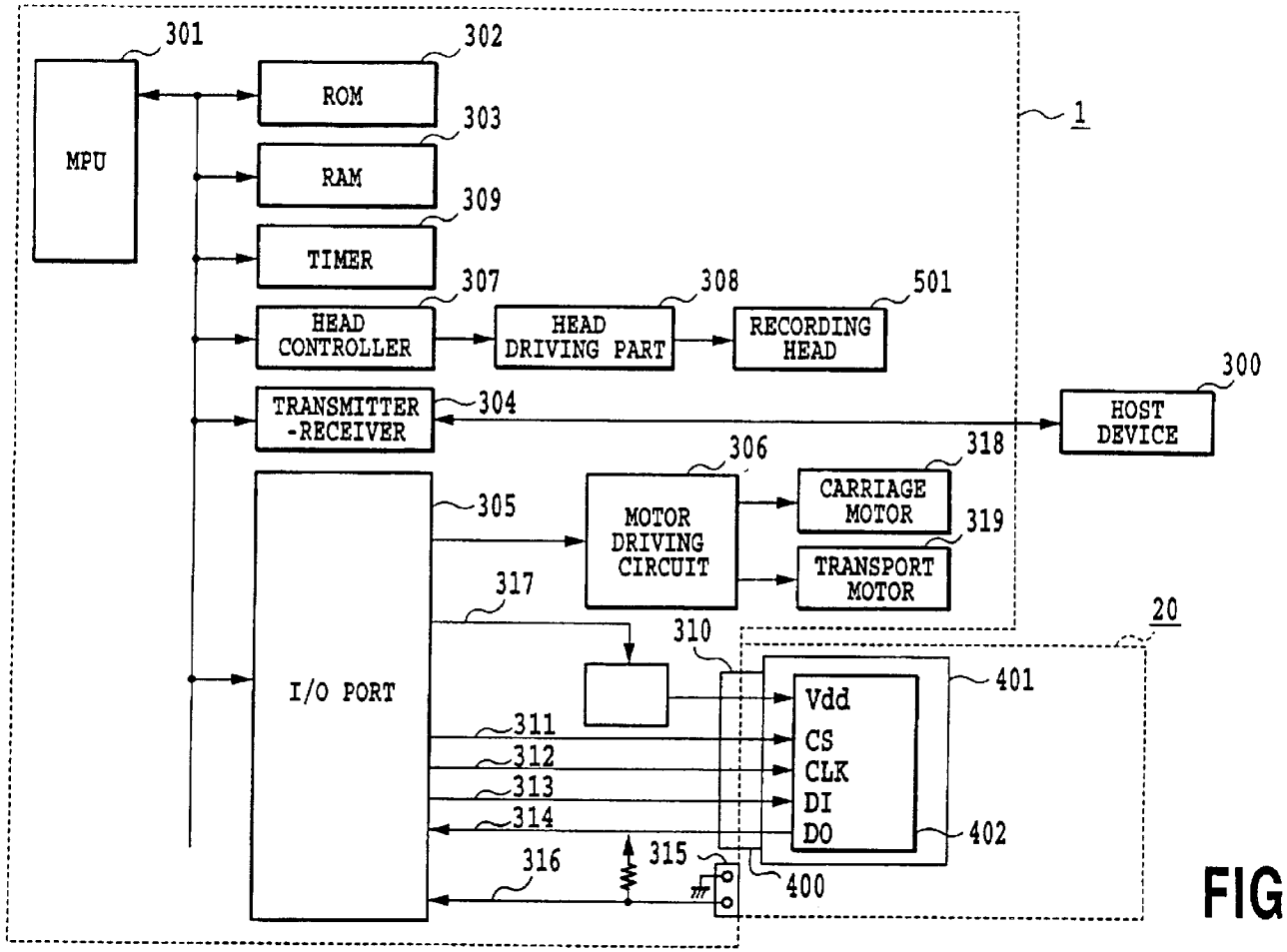
FIG. 11 is a block diagram schematically showing an entire configuration for signal, data communication between the ink jet printer and the ink media pack.

FIG. 11 is a block diagram of a system comprising an ink media pack and an ink jet printing apparatus.

In the ink jet printer 1, a microprocessor (MPU 301) controls the entire ink jet printer in accordance with a control program stored in a ROM 302. A RAM 303 includes a receive data buffer saving printing data transferred from a host apparatus 300 and is used as a work area in which the MPU 301 performs its processes.

The MPU 301 controls rotation of a carriage motor and of a conveyance motor via an I/O port 305 and a motor driving circuit 306, based on command and printing data transferred from the host computer (host apparatus) 300 via a transmission and reception means 304 comprising a well-known centronics interface or the like, in accordance with the procedure of the program stored in the ROM 302. The MPU 301 also outputs the printing data to a printing head 501 via a head control section 307 and a head driving section 308 to control a printing operation of the printing head. In addition, a timer 309 is provided for producing a drive pulse width for the printing head and controlling the rotation speed of each motor.

On the other hand, in the system of the ink media pack 20 connected to the above described ink jet printer to work, a connector 400 for electrically connecting with the printer main body is mounted on a printed circuit board 401 (see FIG. 5). Further, on the printed circuit board 401, an EEPRPOM 402 which enables electric reads and writes 401 and which can retain data even while no voltage is being applied thereto is mounted. The EEPROM 402 of this embodiment is of a general serial type that is operative when a CS signal 311 is at an "H" level. That is, when the CS signal is at the "H" level, a CLK signal 312 rises, a command (write, read, delete, or the like) on a DI input signal 313 or write data is written to the EEPROM 402, and read data are, output onto a DO output signal 314, from which they can then be read. Signal lines 311 to 314 are each connected to the I/O port 305 in the main body via the connector 310 of the main body to accomplish a data read and write under the control of the MPU 301. The serial EEPROM 402 has a capacity of about several-K bits and can be rewritten about $10^5$ to $10^7$ times; it is thus suitable as a rewritable storage element for storing information on the printer of this embodiment.

Furthermore, the ink jet printer has a switch 315 for detecting that the ink media pack 20 is installed, the switch 315 being activated when the ink media pack 20 is installed. An output signal 316 from the switch 315 is input to the I/O port 305. The MPU 301 reads this signal to be able to detect the installation or removal of the ink media pack 20. At the time of detecting the installation of the pack 20, the MPU 301 uses an output signal 317 from the I/O port 305 to supply power to the EEPROM 402 in the pack 20 to enable a read from or a write to the EEPROM 402.

The information stored in the EEPROM 402 in the ink media pack 20 is roughly divided into that written thereto in a factory when the pack is manufactured and which is subsequently simply read out by the ink jet printer, and that rewritten by the ink jet printer after the pack has been installed in the ink jet printer. The former information is represented by the types of printing media and inks set in the pack.

Figure 12:
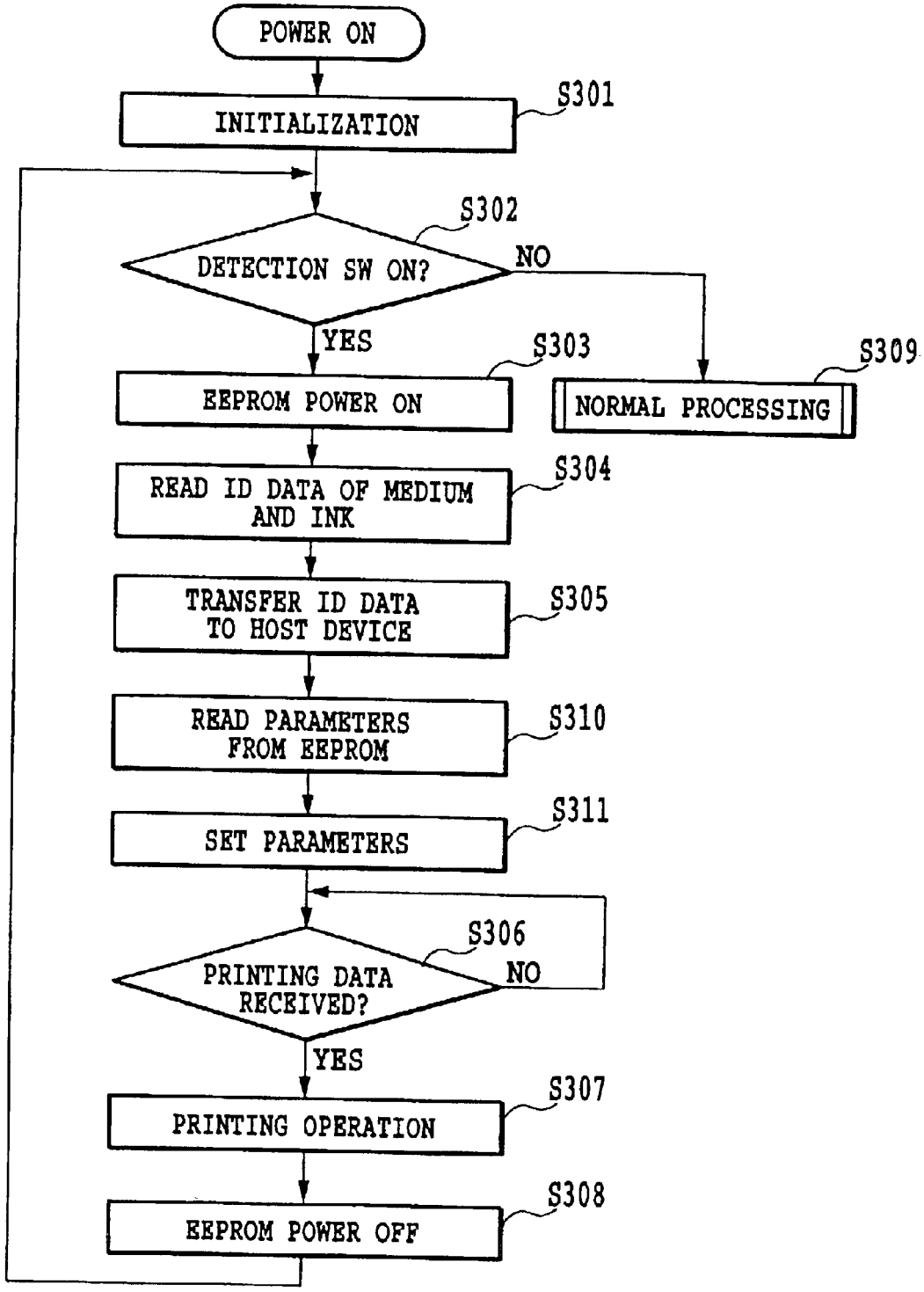
FIG. 12 is a flow chart showing a process executed in the ink jet printer when it is in a state of waiting for printing.

FIG. 12 is a flow chart schematically showing a printing process executed by the ink jet printer of this embodiment and showing a control procedure executed by the MPU 301. The process shown in this figure relates mainly to setting of a printing mode prior to printing and is executed substantially parallel with the process for printing standby described above in FIGS. 9 and 10.

After the power supply to the ink jet printer has been turned on, the MPU 301 initializes the apparatus at step S301. Then, the MPU reads a state of the pack installation detecting switch 315 via the input port 305 at step S302. When the switch 315 is active, the MPU determines that the pack 20 is installed and supplies power to the EEPROM 402 at step S303 to read out various data such as the IDs of the types of printing media and inks accommodated in the ink media pack 20 stored before a shipment (step S304). The MPU transfers the data read out from the EEPROM 402 to the host equipment 300 via the transmission and reception means 304 such as a centroronics interface at step S305. A printer driver in the host equipment 300 automatically creates optimal printing data without the user's selections, based on these information, and then transfers the data to the ink jet printer. The optimal printing data is created by taking into consideration optimal image processing for a combination of printing media and inks in the pack 20 installed in the ink jet printer, the amount of placed ink, and the number of print passes. The printing data is received at step S306, then printing is performed at step S307. Upon completion of one page printing, the power for EEPROM 402 is turned off at step S308, and then shifts to step S302. At step S307, a state of the pack installation detecting switch 315 is read out again via the input port 305.

On the other hand, when the pack installation detecting switch 315 is inactive at step S302, the MPU determines that the pack 20 is not installed and executes a normal printing operation (Step S309). That is, the ink jet printer receives the printing data with the print grade and speed designated by the user at the printer driver, and then executes printing by using ink on the ink jet printer side and the printing media set in the ASF 1. By carrying out the above control, it becomes possible for the ink jet printer to print based on optimized printing data, depending on the combination of the inks and printing media set in the ink media pack without the user's designations, thereby enabling printing with high-grade image quality. Additionally, since it is possible to set various parameters, stored in ROM 302, such as a drive pulse width for the printing head, the number of dots for auxiliary ejection which is used when an auxiliary amount of ink is ejected to prevent the printing head from failing to eject the ink, time intervals for the auxiliary ejection, time intervals for recovery and suction operations required to keep the printing head normal based on the data that MPU 301 read out at step S310 with respect to kinds of printing media and inks, a further optimized control may be possible in addition to the optimization of the printer driver.

On the other hand, in the above embodiment, although kinds of printing media and inks (ID) stored in an ink media pack are read out, parameters with respect to the printing control stored in ROM 302 based on this ID are read out and then set, it may be possible to preliminary store the above data the EEPROM 402 of the ink media pack, directly read out the data from the EEPROM and then set in the printing control circuit of the ink jet printer. By this method, even if, for example, a pack for a combination of printing media and inks that is not assumed before the sale of the ink jet printer is additionally sold, printing is possible with optimal printing control for that combination of printing media and inks.

As another embodiment other than the above, rewritable information from the ink jet printer in the state that the ink media pack is installed on the ink jet printer may be the number of printing media in the pack and a amount of remaining ink in the pack.

Figure 13:
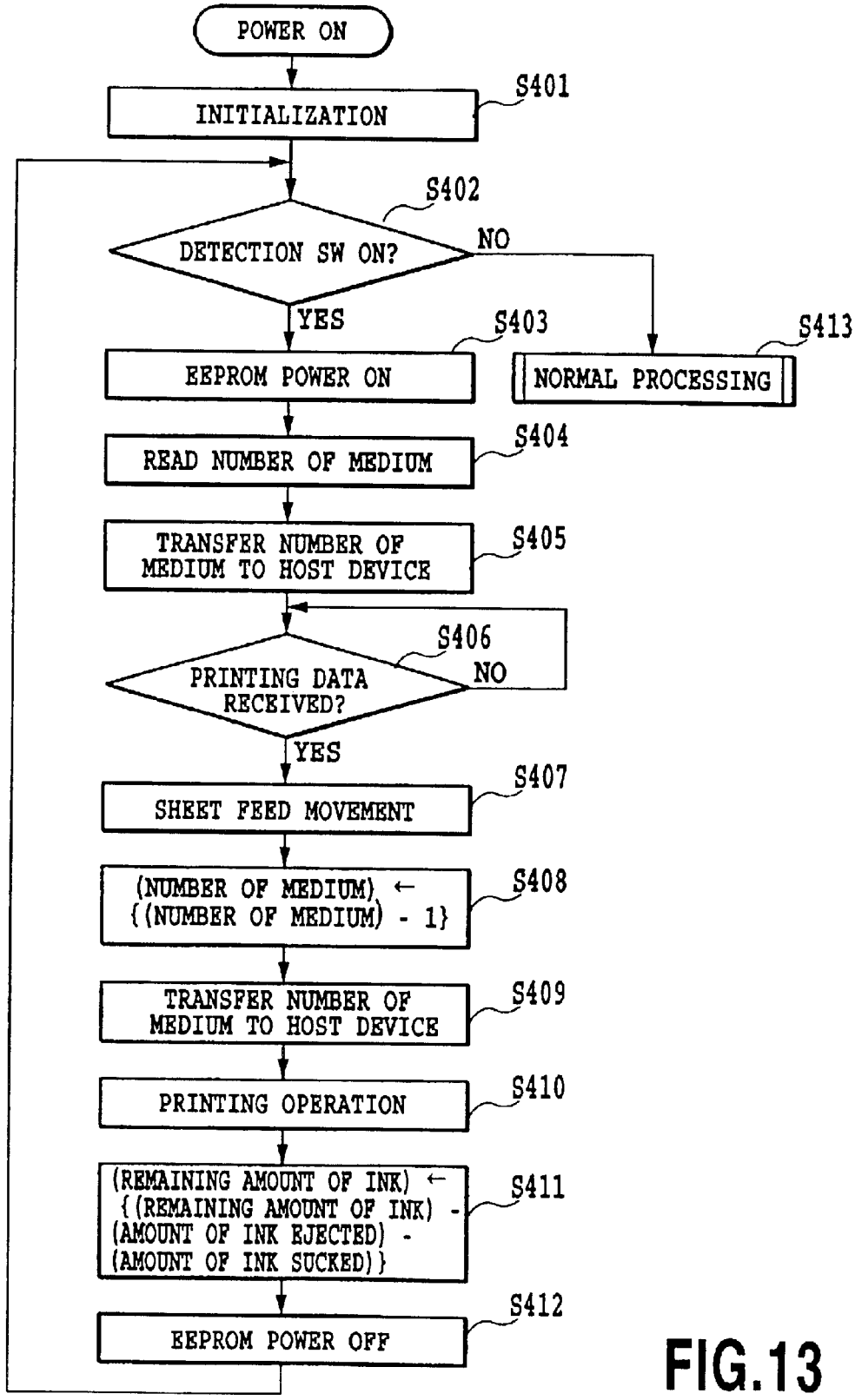
FIG. 13 is a flow chart showing another process executed in the ink jet printer when it is in a state of waiting for printing.

FIG. 13 is a flow chart showing an example of another control provided by the MPU 301.

In FIG. 13, after the ink jet printer has been turned on, the MPU 301 initializes the apparatus at step S401. Next, at step S402, the state of the installation detecting switch 315 for the ink media pack 20 is read out via the I/O port 305. When the switch 315 is active, then it is determined that the ink media pack 20 is installed. At step S403, the power is supplied to the EEPROM 402 to read the number of remaining printing media stored in the EEPROM 402 (step S404). At step S405, the read data are transferred to the host equipment 300 via the above mentioned transmission and reception means 304 such as a centronics interface.

A status monitor of the host equipment displays the current number of remaining printing media housed in the ink media pack 20 on the monitor. Then, when it is determined at step S406 that the printing data have been received from the host equipment, a printing medium in the ink media pack 20 is fed at step S407. Then, at step S408, the data on new value equal to the number of currently remaining printing media minus one is written to the EEPROM 402 and transferred to the host equipment 300. The number of remaining printing media displayed on the monitor is changed (S409) and the printing operation is performed at step S410. Once printing has been completed for one sheet, then at step S411, the data on value of the amount of remaining ink is read out from the EEPROM 402 for each color. Then, the amount of ink ejected for the printing for this sheet and the amount of preliminary ejection are subtracted from the read value or the amount of sucked ink is subtracted from the read value if a suction operation has been performed, and the data on the result as a new amount of remaining ink is written to the EEPROM 402. Subsequently, at step S412, assuming that the ink media pack 20 is to be removed, the process shifts to step S402 to repeat the processes set forth above.

Precisely speaking, the amount of ink remaining in the ink housing section should be calculated based on the amount of ink supplied from the ink housing section to the sub-tank in the carriage. Since, however, a small amount of ink is housed in the sub-tank and the ink is thus frequently supplied from the ink housing section to the sub-tank, the amount of ink ejected for printing, the amount of ink for preliminary ejection, and the like can be directly used to calculate the amount of ink remaining in the ink housing section.

The above process enables the current number of printing media in the ink media pack 20 to be determined so that this data can be transmitted to the host equipment 300, where it can be displayed on a CRT of the host equipment 300, thereby improving the user interface. Additionally, the latest state of the interior of the ink media pack 20 can always be determined so that this information can be read and used for a process of determining the amount of inks injected for recycling or other processes.

Next, an ink replacing system and an ink supplying method included in this embodiment will be described.

The ink replacing system of this embodiment supplies the ink from each ink tank housing section of the above described ink media pack, which is an ink source, to the corresponding sub-tank mounted in the carriage of the printing apparatus main body. It principally comprises sub-tanks, printing heads, ink-air introducing mechanism, and others.

Figure 14:
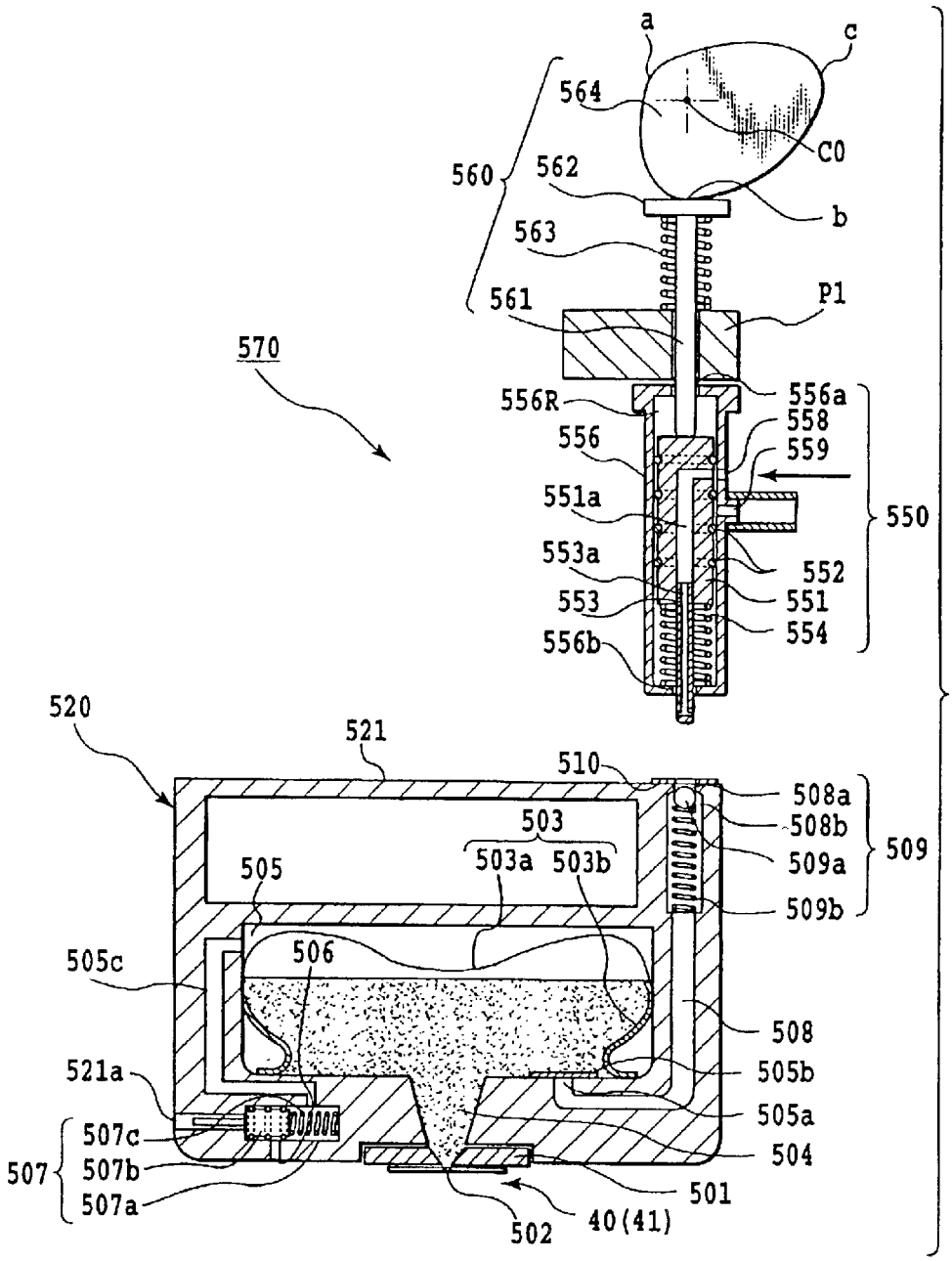
FIG. 14 is a vertical cross-sectional side view showing a sub-tank, a printing head, and an ink air supplying mechanism in an ink replacing system of the above printer and showing how these components operate during a printing operation.
Figure 15:
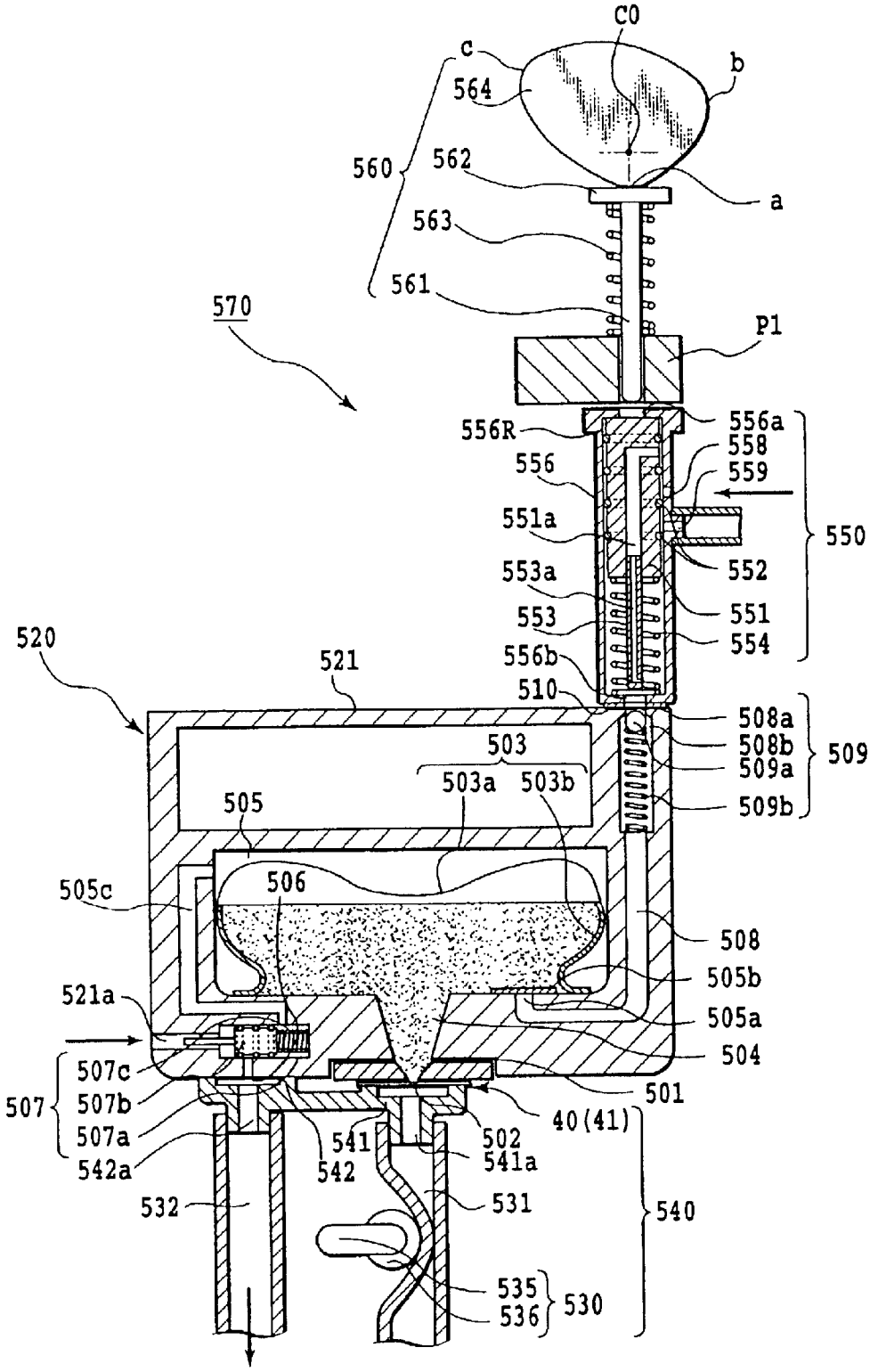
FIG. 15 is a vertical cross-sectional side view showing a sub-tank, a printing head, and an ink air supplying mechanism in an ink replacing system of the above printer and showing how these components operate when the sub-tank has its pressure reduced.
Figure 16:
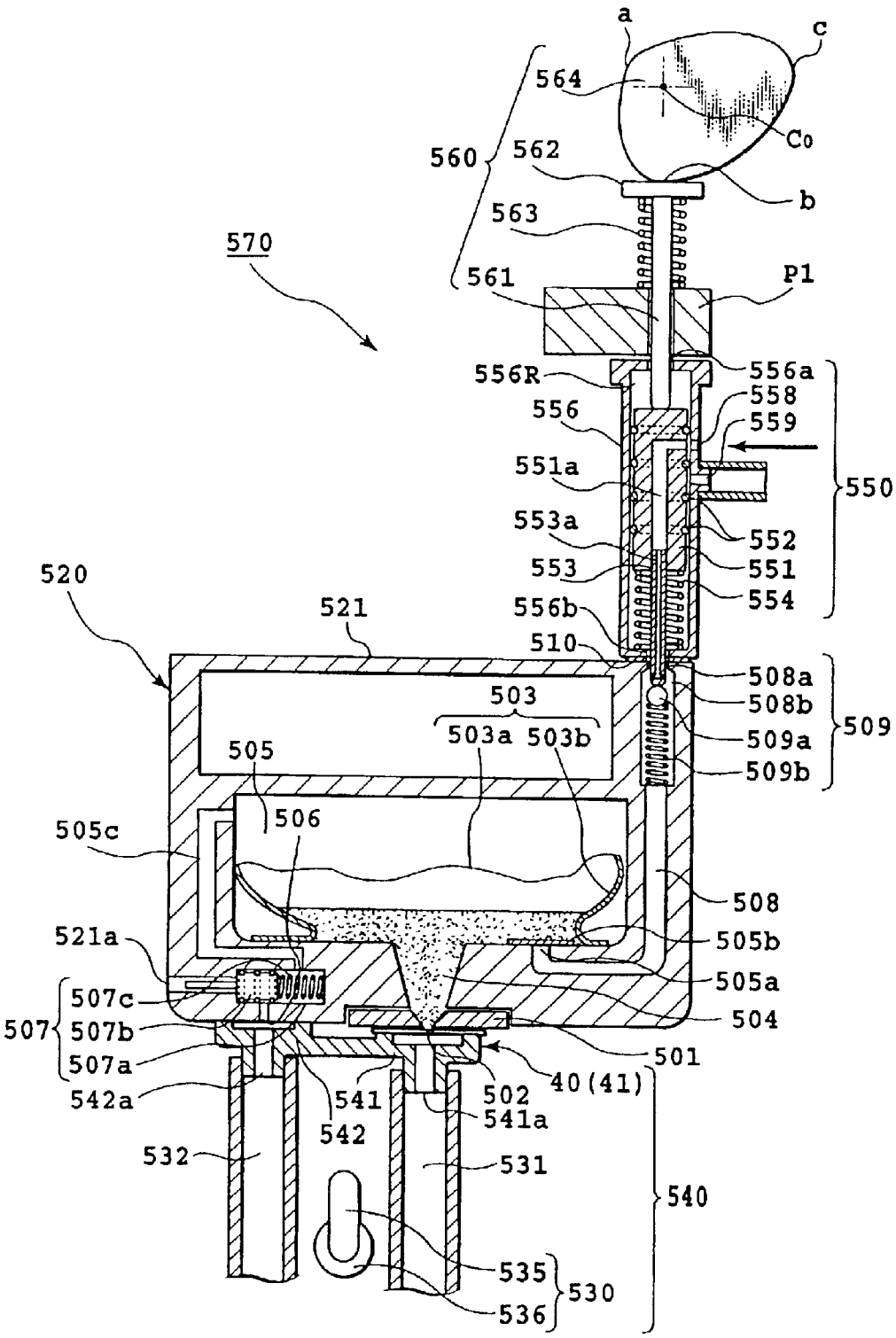
FIG. 16 is a vertical cross-sectional side view showing a sub-tank, a printing head, and an ink air supplying mechanism in an ink replacing system of the above printer and showing how these components operate is when air is introduced.
Figure 17:
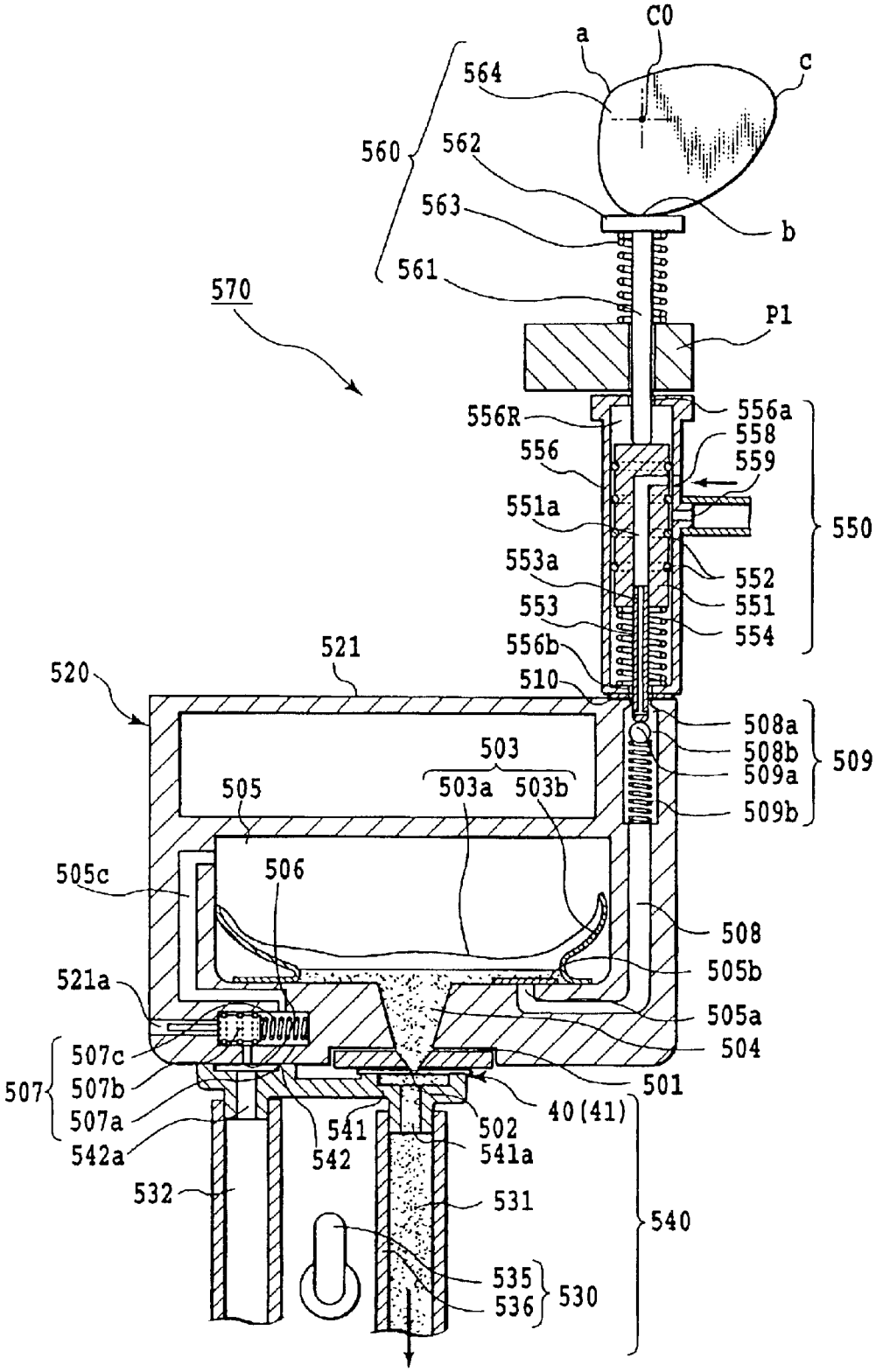
FIG. 17 is a vertical cross-sectional side view showing a sub-tank, a printing head, and an ink air supplying mechanism in an ink replacing system of the above printer and showing how these components operate during an ink air discharging operation.
Figure 18:
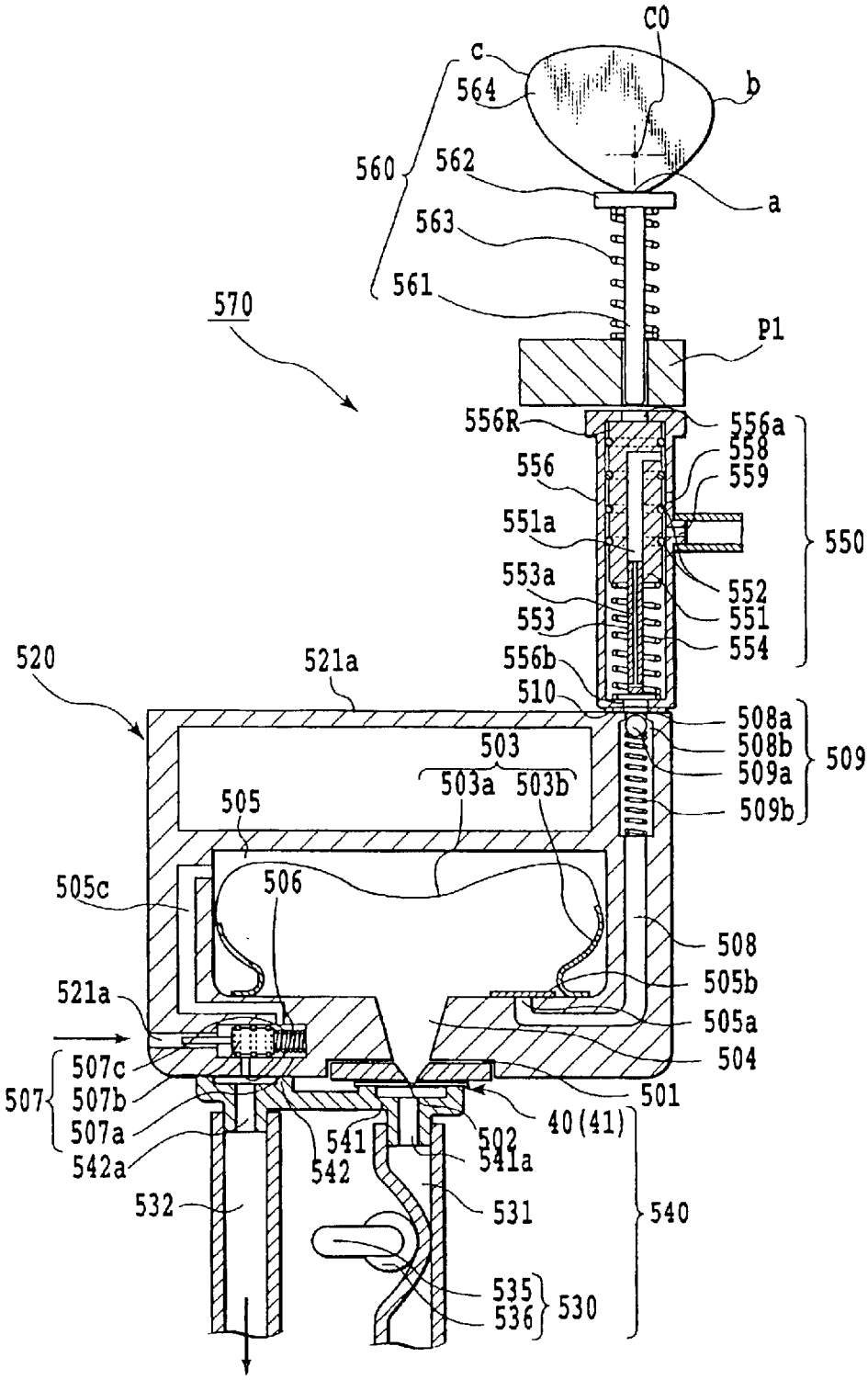
FIG. 18 is a vertical cross-sectional side view showing a sub-tank, a printing head, and an ink air supplying mechanism in an ink replacing system of the above printer and showing how these components operate when the sub-tank has its pressure reduced again.
Figure 19:
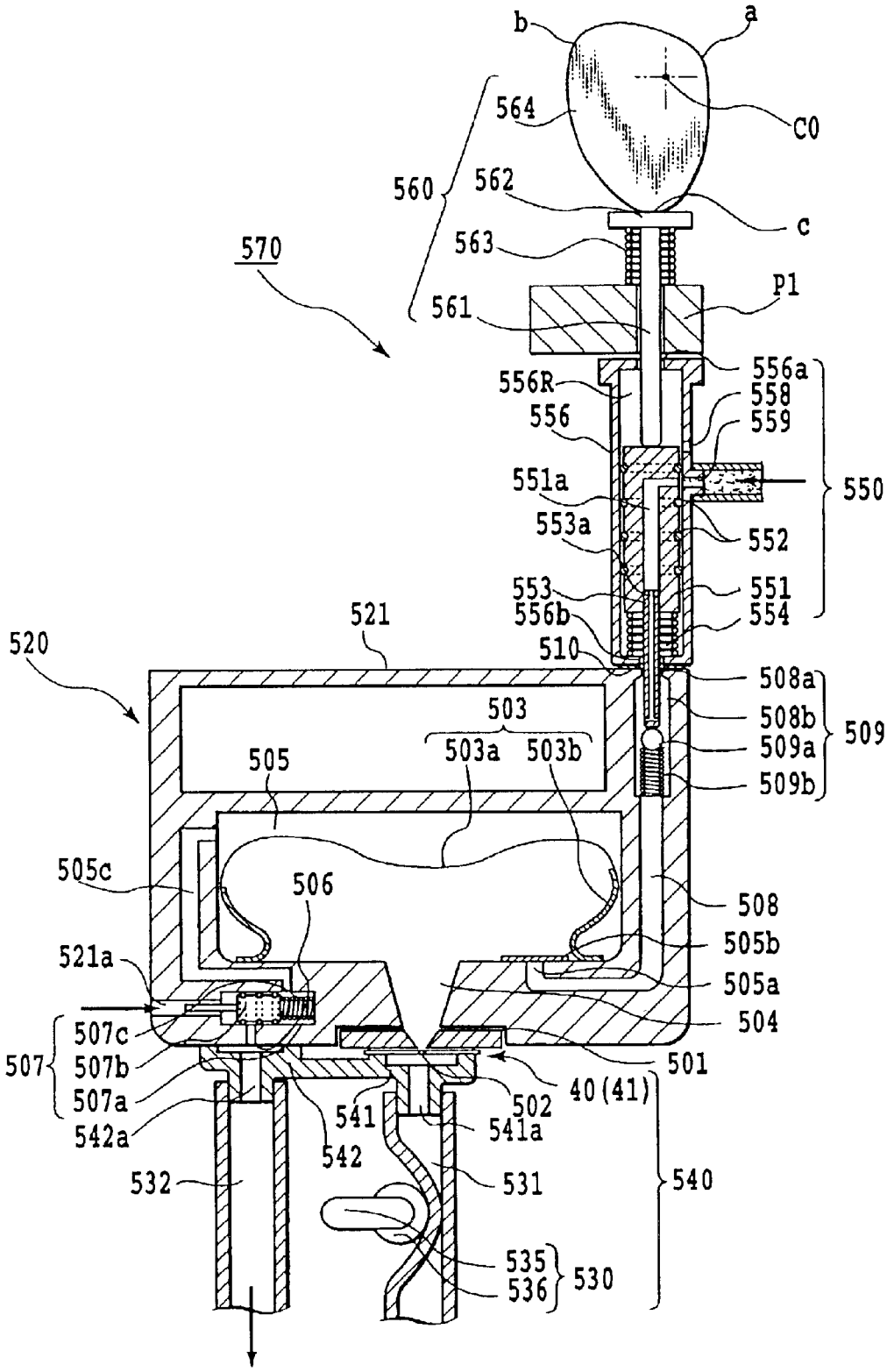
FIG. 19 is a vertical cross-sectional side view showing a sub-tank, a printing head, and an ink air supplying mechanism in an ink replacing system of the above printer and showing how these components operate when ink is introduced.

FIGS. 14 to 19 are side vertical sectional views showing the sub-tank, the printing head, and the ink-air introducing mechanism of the ink replacing system. FIG. 14 shows how these components operate while the printing operation is being performed, FIG. 15 shows how these components operate when the pressure of the sub-tank is reduced, FIG. 16 shows how these components operate while an air is introduced, FIG. 17 shows how these components operate while an ink and air discharging operation is being performed, FIG. 18 shows how these components operate when the pressure of the sub-tank is reduced again, and FIG. 19 shows how these components operate when an ink is introduced.

In each figure, reference numeral 501 denotes a printing head having a large number of electrothermal converters or electrostrictive elements (not shown) arranged therein and acting as a source of ink ejecting pressure, and a large number of nozzle sections also arranged therein and each having an ejection port 502 for ejecting an ink. A source of ink ejecting pressure in each nozzle section is connected with a head driving circuit for supplying a printing signal (not shown) and electricity.

Reference numeral 520 denotes a sub-tank for storing an ink supplied from the ink housing section 211 formed in the ink media pack and acting as an ink source, the sub-tank having the printing head 501 connected integrally with its bottom portion.

In the sub-tank 520, reference numeral 521 denotes a sub-tank main body constituting an outer shell of the sub-tank 520 and having decompression chambers 505 identical to applied ink types in number (in this case, four types). The decompression chambers 505 are each connected to an intake passage 505*c* that is in communication with a pressure reduction adjusting port 506 formed at a bottom of the sub-tank main body 521.

Figure 20:
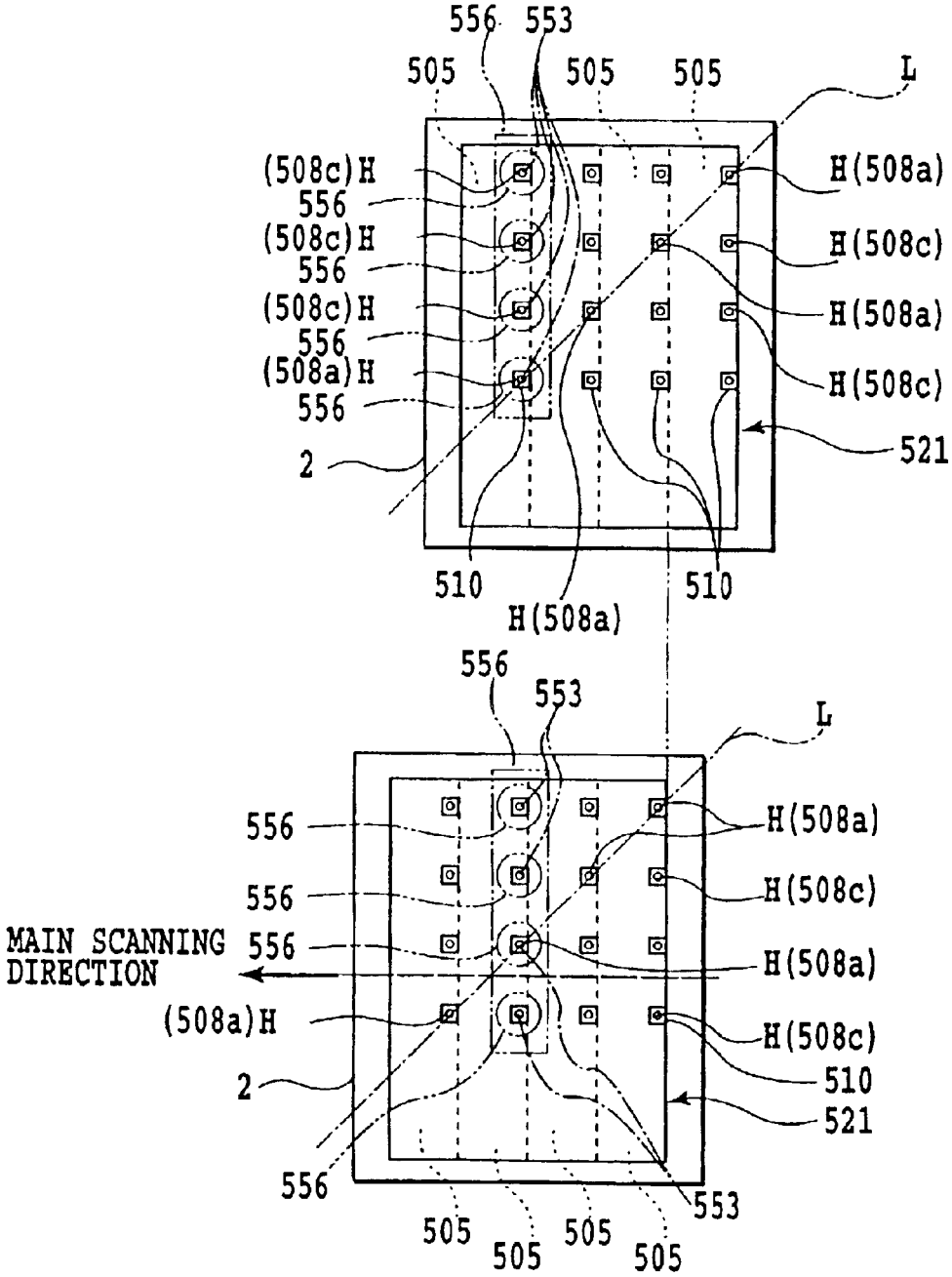
FIG. 20 is an explanatory top view showing an ink introducing hole or the like in the sub-tank.

Additionally, each sub-tank main body 521 has four holes H including the above mentioned introduction port 508*a* and formed on a top surface thereof in a line along a vertical direction (that is orthogonal to a main scanning direction) in such a manner as to correspond to one of the decompression chambers 505 as shown in FIG. 20. The entire sub-tank has 16 holes H in the form of a matrix. Of these holes, the four introduction ports 508*a* formed in each decompression chamber 505 are arranged on a line crossing the main scanning direction, corresponding to the moving direction of the carriage. On the other hand, the holes H other than the introduction ports 508*a* are an opening of recesses 508*c* through which introduction needles 553, described later, are passed and each of which has an elastic ink leakage preventing member (not shown) fixed to a bottom surface of the recess 508*c*.

Further, the introduction passage 508 has a sealing mechanism 509 for sealing the introduction port 508*a* formed in an upper end portion of the passage 508 in such a manner that the port can be opened and closed. The sealing mechanism 509 comprises a ball valve 509*a* housed in a valve housing chamber 508*b* formed in the upstream portion of the introduction passage 508, and a spring 509*b* for urging the ball valve 509*a*. An urging force of the spring 509*b* causes the introduction port 508*a* to be normally sealed with the ball valve 509*a*. Reference numeral 510 denotes an ink leakage preventing member made of an elastic member and fixed to an outside of the introduction port 508*a*. In addition, reference numeral 505*b* denotes a lead-out valve provided in a lead-out port 505*a* to the introduction passage 508 and which enables inks and air to be lead out to the introduction passage 508, while hindering the ink and air from flowing backwards from the introduction passage 508.

Reference numeral 507 denotes a pressure reduction adjusting mechanism inserted into the intake passage 505*c*. The pressure reduction adjusting mechanism 507 comprises a valve housing chamber 507*a* formed in the suction passage 505*c*, a pressure reduction adjusting valve 507*b* inserted into the valve housing chamber 507*a*, and a spring 507*c* for urging the pressure reduction adjusting valve 507*b*.

The pressure reduction adjusting valve 507*b* normally keep communication between the intake passage 505*c* and the pressure reduction adjusting port 506 shut off by means of the urging force of the spring 507*c*. However, when a predetermined pressurizing member (not shown) is inserted through an insertion hole 521*a* formed in a side surface of the sub-tank main body 521 and the pressure reduction adjusting valve 507*b* is moved against the urging force of the spring 507*c*, the pressure reduction adjusting port 506 and the intake passage 505*c* communicate with each other via an intake passage (not shown) formed in the pressure reduction adjusting valve 507*b* to reduce the pressure in the decompression chamber 505.

Thus, the pressure reduction adjusting valve 507*b* is shut off from outside air to maintain a reduced pressure therein because the pressure reduction adjusting port 506 is closed except when the degree of pressure reduction is to be adjusted. When the pressure reduced state is thus formed, the ink in the sub-tank 505 has its pressure reduced to preclude the ink from dropping, while preventing air from being drawn in through the ejection port 502. Consequently, an appropriate ink meniscus can be formed at the ejection port 502 to quest for stabilizing the ink ejection. The adjustment of a degree of pressure reduction can be managed by providing in the intake passage 505*c* with a pressure sensor acting as a pressure reduction measuring means.

Reference numeral 503 denotes an ink liquid chamber housed in the above mentioned decompression chamber 505 and acting as an ink storage section. The ink liquid chamber 503 is shaped like a bag and formed of a flexible member having a lower end portion thereof fixed to a bottom surface portion of the decompression chamber. The ink liquid chamber 503 has its volume varying with a difference between its exterior and interior. In this embodiment, the flexible member comprises a lower half 503*b* formed to be thick and an upper half 503*a* formed to be thin, and the lower half 503*b* is relatively rigid and maintains a constant shape, whereas the upper half 503*a* is not so rigid and has its volume varying depending on a difference between its exterior and interior resulting from the decompression chamber. This configuration serves to reduce the internal volume during the ink discharging operation to lessen the amount of remaining ink. Thus varying the thickness of ink liquid chamber, however, is not essential to the present invention.

In addition, the ink liquid chamber 503 is in communication with the printing head 501 via the ink supplying passage 504 formed at the bottom of the decompression chamber 505 so that the ink from the ink liquid chamber 503 can be supplied to the printing head 501 via the ink supplying passage 504.

Further, reference numeral 540 denotes a pressure reduction applying mechanism (pressure reducing means) provided in the recovery mechanism 42. The pressure reducing mechanism 540 comprises the above mentioned pair of caps 40 and 41, suction pumps (not shown) each provided correspondingly to one of the caps 40 and 41 and acting as a source of pressure reduction, two sets of pressure reducing paths 531 and 532 that each connect the suction pump and the cap together, an ejection port 502 of the printing head 501, and a switching mechanism 530 for switching a pressure reduction applying state of a pressure reduction adjusting port 506. The caps 40 and 41 each comprise an ejection-port-side sealing section 541 that covers and seals the ejection port 532 and a pressure-reducing-port-side sealing section 542 that covers and seals the pressure reduction adjusting port 506, as shown in FIGS. 1 and 15. The sealing sections 541 and 542 have suction holes 541*a* and 542*a* formed therein, respectively.

Additionally, the above mentioned two pressure reducing paths 531 and 532 are composed of two tubes 531 and 532 connected to suction holes 541*a* and 542*a* is in the sealing sections 541 and 542, respectively, and one 531 of the tubes is formed of a flexible member. Further, the pressure reduction switching mechanism 530 comprises a rotational movement arm 535 positioned between the tubes 531 and 532 by a predetermined drive source and rotationally moved by a predetermined drive means, and a compressible connection roller 536 axially attached to one end of the rotational movement arm 535, wherein selecting the position of compressible connection roller 536 by the rotational movement arm 535 allow selection between a communication state and a shut-off state in the tube 531.

That is, when the compressible connection roller 536 is brought into connect with the tube 531 compressibly as shown in FIGS. 15, 18, and 19, the tube 531 is collapsed to shut off the communication therein to block the ejection-port-side sealing section 541 off from the suction pump. In contrast, when the compressible connection roller 536 is separated from the tube 531 as shown in FIGS. 16 and 17, the tube 531 recovers to its original shape to make the sealing section 541 in communication with the suction pump.

On the other hand, reference numeral 570 denotes an ink-air introducing mechanism. The ink-air introducing mechanism 570 selectively introduces an ink and outside air into the ink liquid chamber 503 in the sub-tank 521 to function as an ink introducing mechanism or a gas introducing mechanism. Additionally, the ink-air introducing mechanism has two types of ink-air introducing mechanism: an paper-side one for introducing an ink and air from the above mentioned ink refilling unit 30 and an ink-media-pack-side one for introducing an ink and air from the interior of the ink media pack 20. Both ink-air introducing mechanisms have the same structure and comprise a pressurizing mechanism 560 and an introduction switching mechanism 550.

The pressurizing mechanism 560 of the paper-side ink-air introducing mechanism is installed based on a position where the above mentioned paper-ink refilling cap, 40, while the pressurizing mechanism 560 of the pack-side ink-air introducing mechanism is installed based on a position where the special-paper-ink refilling cap 41 housed in the ink media pack 20 is disposed. In addition, pressurizing pins 561 of each pressurizing mechanisms 560 are arranged in a line along a direction (sub-scanning direction) orthogonal to the moving direction (main scanning direction) of the carriage 2.

Further, one of the introduction switching mechanisms 550 is provided in a supply section 30*a* of the paper-ink refilling unit 30, while the other is provided in a supply section 21*a* of the ink media pack 20.

Additionally, the pressurizing mechanism 560 comprises the plurality of (in this case, four) pressurizing pin 561 penetrating a predetermined support P1 on the printer main body in such a manner as to elevate and lower freely, a spring 563 installed with elasticity between a head 562 of each pressurizing pin 561 and the support P1 to normally apply such a urging force that a lower end portion of the pressurizing pin 561 sinks into the support P1, a single eccentric cam 564 rotationally moved around a rotational movement center Co by means of a predetermined drive source. The eccentric cam 564 is provided where it is always connected with the head 562 of each pressurizing pin 561 compressibly, and allow to move rotationally around the rotational movement center Co to move all the pressurizing pins 561 upward and downward. That is, when a point a (where the distance from the rotational movement center Co is smallest) on a circumferential surface of the eccentric cam 564 comes into contact with the head 562 of the pressurizing pin 561, a lower end portion of the pressurizing pin 561 is set in its initial position where it sinks into the support P1. When a point c (where the distance from the rotational movement center Co is largest) on the circumferential surface of the eccentric cam 564 comes into contact with the head 562 of the pressurizing pin 561, the lower end portion of the pressurizing pin 561 is set in its maximum projecting position where it projects furthest from a bottom surface of the support P1. Furthermore, when a point b on the circumferential surface of the eccentric cam 564 comes into contact with the head 562, the lower end portion of the pressurizing pin 561 is set in its intermediate position between the initial position and the maximum projecting position.

On the other hand, the introduction switching mechanism 550 comprises an enclosure 556 having a plurality of (in this embodiment, four) housing chambers 556R partitively formed correspondingly to the pressurizing pins 561, switching blocks 551 each accommodated in the corresponding housing chamber 556R of the enclosure 556 in such a manner as to become capable of moving up and down, introduction needles 553 each fixed a lower end of the corresponding switching block 551 and having an introduction passage 553*a* formed in a central portion thereof, and springs 554 each elastically installed between the switching block 551 and the bottom of the enclosure 556.

The enclosure 556 has a plurality of (in this embodiment, four) insertion holes 556*a* formed in a top surface thereof in such a manner as to correspond to the pressurizing pins 561 of the above described pressurizing mechanism and into and from which the corresponding pressurizing pin 561 can be inserted and removed, and has a plurality of (in this embodiment, four) insertion holes 556*b* formed in a bottom surface thereof in such a manner as to correspond to the introduction needles 553, which the introduction needles 553 can be inserted and removed. Furthermore, each housing chamber 556R of the enclosure 556 has an air introducing port 558 and an ink introducing port 559 formed in a side surface thereof. The air introducing port 558 is in communication with outside air, and the ink introducing port 559 is connected via a predetermined communication passage to the paper-ink refilling unit 30, which is a source of inks, or the ink housing section 211 of the ink media pack 20. Additionally, the switching blocks 551 can each be elevated and lowered through the corresponding housing chamber 556R of the enclosure 556 by means of an O-ring 552 fixed to a circumferential surface of the switching block, while maintaining a gas-tight contact with an inner surface of the housing chamber 556R. The switching block 551 has an introduction passage 551*a* bent in the form of the character L in a fashion leading from a side opening formed in one side surface of the passage to a bottom opening formed in the center of a bottom portion of the passage; the introduction passage 551*a* is in communication with the introduction passage 553*a* in the above mentioned introduction needle 553.

Moreover, the introduction needles 553 are arranged in the sub-scanning direction similarly to the pressurizing pins 561 of each pressurizing mechanism 560. Accordingly, the introduction ports 508*a* are arranged in a direction crossing the arranging direction of the introduction needles 553 within the enclosure 556 as shown in FIG. 28. A disposing pitch for the introduction ports 508*a* in the sub-scanning direction, however, is set the same as that for the introduction needles so that the carriage 2 can be moved in the main scanning direction to sequentially align on a one by one basis among four pieces of the introduction needles 553 with the corresponding introduction ports 508*a* as shown in FIG. 28. This introduction switching mechanism constitutes an ink introduction switching means and a gas introduction switching means.

Next, an ink replacing operation and an ink supplying operation according to this embodiment will be explained.

As described previously, this embodiment performs switching of the printing operation between the one with special paper from the ink media pack 20 or the like and the one with paper from the same, a change in the type of the media pack 20 used, and other operations, so that the types of applied inks must be changed in connection with a change in printing media, thereby requiring stored inks to be replaced with inks to be used for the next printing operation.

This ink replacement is carried out as shown in FIGS. 14 to 19. Description will be made by taking by way of example an operation executed to replace the inks in connection with a change in the type of the ink media pack 20.

When a replacement command is input to replace the ink media pack, the carriage 2 with the sub-tank 520 mounted therein moves to a receding position at a side of the apparatus where it can avoid interfering with the ink media pack 20(see FIG. 1). Then, the ink media pack 20 being used is removed.

Subsequently, a new ink media pack 20 is installed and the pressurizing mechanism 560 is moved from the receding position to an installation position at a lateral side of the apparatus. Then, the bottom portion of the enclosure 556 in the introduction switching mechanism 550 is located close to the top surface of the sub-tank main body 521, and the pressurizing pins 561 of the pressurizing mechanisms 560 are opposed to the corresponding insertion holes 556*a* formed in the top surface of the enclosure 556.

Then, the information on the ink stored in each ink liquid chamber 503 is read out from the memory 400 for the newly installed ink media pack 20, and when the ink replacing command is input, the MPU 301 determines which inks must be replaced based on the current ink information and the information on the ink used last.

Based on this determination, the carriage 2 moves to oppose the pressure reduction adjusting port 506 formed in the bottom surface of the decompression chamber 505 storing the ink to be replaced as well as the ejection port 502 in the printing head 501, to the sealing sections 541 and 542, respectively, provided in the cap 40 or 41. Subsequently, the cap 40 or 41 elevates to bring the sealing sections 541 and 542 into tight contact with peripheries of the ejection port 502 and the pressure reduction adjusting port 506 (see FIG. 15).

Thereafter, the rotational movement arm 535 of the pressure reduction switching mechanism 530 rotates to bring the compressible connection roller 536 into connection with the tube 531 compressibly to thereby shut off the communication between the ejection port 502 and the suction pump. On the other hand, the pressure reduction switching valve 507*b* is pushed in by a push-in member (not shown) against the urging force of the spring 507*c* and the decompression chamber 505 is allowed to communicate with the suction pump via the pressure reduction adjusting valve 507*b* or the like. In this case, since the introduction passage 508, which can communicate with the decompression chamber 505, is shut off from outside air by the sealing mechanism 509, the interior of the decompression chamber 505 has its pressure reduced by means of an air sucking operation of the suction pump. In addition, the upper half 503*a* of the ink liquid chamber 503 housed in the decompression chamber 505 is formed of a flexible member, so that when the pressure in the decompression chamber 505 is reduced than the atmosphere, the ink liquid chamber 503 has its volume changed correspondingly to have its pressure reduced.

Then, when the decompression chamber 505 reaches a fixed degree of pressure reduction, the pressurizing member (not shown) cancels the pressure on the pressure reduction adjusting valve 507*b*, which thus returns to its initial position due to the urging force of the spring 507*c* to shut off the communication between the intake passage 505*c* and the suction pump to thereby maintain a state of the reduced pressure in the decompression chamber 505 and in the ink liquid chamber 503 (see FIG. 15).

Then, the eccentric cam 564 is rotated around the rotational movement center Co by the drive means (not shown) and then stopped where its circumferential point b comes into contact with the head 562. This causes the pressurizing pin 561 to project from the bottom surface of the support P1 and pass through the insertion hole 556*a* into the enclosure 556 to push the switching block 551 downward, so that the air introducing port (gas introducing port) 558 and the introduction passage 551*a* communicate with each other (see FIG. 16). As a result, outside air is introduced into the ink liquid chamber 503, having its pressure reduced, from the air introducing port 558 through the introduction passages 551*a*, 553*a*, and 508 and the introduction valve 505*b*. This pressure reduction and air introduction causes the ink to be rolled and agitated inside the ink liquid chamber 503 to allow the ink to flow more smoothly.

Then, the suction pump, acting as a source of suction, is activated to discharge the ink used for the last printing operation and remaining in the ink liquid chamber 503, from the ejection port 502 via the tube 531 (see FIG. 17). This discharge step enables the ink in the ink liquid chamber 503 to be completely discharged, but for more reliable discharge, it is also effective to repeat the above described pressure reducing, air introducing, and discharge steps or reciprocate the carriage 2*a* predetermined distance to roll the internal ink.

After the ink has completely been discharged, the eccentric cam 564 is rotated to bring its circumferential point a into the head 562, as shown in FIG. 18. This causes the pressurizing pin 561 to return to its initial position located above due to the urging force of the spring 563 to exit the enclosure 556 of the introduction switching mechanism 550. Consequently, the introduction needle 553, with the switching block 551, elevates due to the urging force of the spring 554 to exit the introduction port 508*a*. Thus, the urging force of the spring 509*b* causes the ball valve 509*a* to occlude the introduction port 508*a* to the introduction passage 508 to thereby shut off the communication between the introduction port 508*a* and outside air.

At the same time, the pressure reduction adjusting valve 507*b* of the pressure reduction adjusting mechanism 507 is pressed against the force of the spring 507*c* to allow the intake passage 505*c* and the tube 532 to communicate with each other, thereby allowing the decompression chamber 505 to communicate with the suction pump. On the other hand, the compressible connection roller 536 of the pressure reduction switching mechanism 530 is used to shut off the communication between the ejection port 502 and the suction pump, which is then driven. As a result, the ink liquid chamber 503 has its pressure reduced again.

Then, the pressurizing mechanism 560 is driven to rotate the eccentric cam 564 to bring its circumferential point c into connect with the head 562 compressibly (see FIG. 19). This causes the pressurizing pin 561 to project downward to move the switching block 551 to its maximum projecting position to thereby allow the ink introducing port 559 and the introduction passage 551*a* to communicate with each other. This in turn enables communication through the path from the ink media pack 20, which is a source of inks, to the ink liquid chamber 503, that is, the path from the ink media pack 20 through the ink supplying tube 218*c*, ink introducing port 559, and introduction passages 551*a*, 553*a*, and 508 to ink liquid chamber 503.

In this case, during the pressure reduction step shown in FIG. 23, both the ink liquid chamber 503 and the decompression chamber 505 have their pressures reduced, so that the ink stored in the ink media pack 20 is introduced into the ink liquid chamber 503 via the path set forth. Once the ink liquid chamber 503 then is filled with the ink, the eccentric cam 564 is rotated to remove the pressurizing pin 561 from the enclosure 556 to remove the introduction needle 553 from the introduction port 508*a* to thereby complete the ink introducing step, thereby completing the ink replacing step for the one ink housing chamber. In this regard, the operation during the ink introducing step is identical to the operation executed to supply the ink, which has been consumed by the printing or recovery operation.

In addition, after the introduction needle 553 has been removed after the ink filling as in FIG. 23, the degree of pressure reduction may further be adjusted in order to make the pressure in the sub-tank 520 suitable for the printing operation.

After the ink liquid chamber 503 in one of the decompression chambers 505 in the sub-tank 520 has been supplied with the ink as described, if another ink liquid chamber 503 must be supplied with the ink, the cap 40 or 41 first lowers to separate from the bottom surface of the sub-tank 505, and the above described elevating and lowering mechanism then lowers the carriage 2 with the sub-tank to separate from the enclosure 565. Subsequently, the carriage 2 moves in the main scanning direction to oppose the pressure reduction adjusting port 506 and ejection port 502 in the another pressure reduction chamber 505 to the cap 40 or 41. Then, the cap 40 or 41 elevates again to seal the pressure reduction adjusting port 506 and the ejection port 502, and then the pressure reducing, air introducing, discharge, pressure reducing, ink introducing, and other steps are subsequently sequentially executed as described above. The above operation is repeated for each decompression chamber 505 for which the ink must be replaced.

The four pressurizing mechanisms 560 provided in this embodiment are structured so that the single eccentric cam 564 simultaneously elevates and lowers equal parts all the pressurizing pins 561. Thus, all the switching blocks 551 and introduction needles 553 of the introduction switching mechanism 550 are simultaneously pressed in response to the pressurizing operation of the pressurizing pins 561.

However, only one of the introduction needles 553 among each introduction needles 553 is inserted into the introduction port 508*a* as described above, with the other introduction needles 553 inserted into those three of the twelve introduction-needle inserting recesses 508*c* formed in the top surface of the sub-tank main body 521*a* which belong to the same row. The recesses 508*c* each have the appropriately elastic ink-leakage preventing member on its bottom surface in such a manner that the lower end of the introduction needle 553 inserted into the recess 508*c* comes into connect with this ink-leakage preventing member compressibly. Thus, unwanted ink leakage can be prevented without damaging the tip of the introduction needle 553. Additionally, since the introduction port 508*a* of the introduction passage 508 not having the introduction needle 553 inserted thereinto is kept occluded by the ball valve 509, no dust can enter the introduction passage 508.

Although the introduction passages 551*a*, 553*a*, and 508 in this embodiment are used both for inks and for air to allow both of them to flow therethrough, ink introduction passages and an air introduction passage may be separately provided.

In addition, in this embodiment, the ink is discharged from the ink liquid chamber by ejecting it from the ejection port in the printing head 501, but an ink ejecting channel having a relatively large flow area may be formed separately from the ejection port to eject the ink therethrough, thereby increasing ink discharging speed and preventing a decrease in the lifetime of the ejection port caused by the ink discharge.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A media pack having one container inside which an ink receptacle portion and a printing medium, on which ink is fixed, receptacle portion are provided, said media pack comprising:

a container body;

printing media received in said printing medium receptacle portion, said printing media being cloth cut in a predetermined size in alignment, a specified number of sheets of the cloth being stacked and received in said printing medium receptacle portion; and ink received in said ink receptacle portion, said ink containing dye suitable for dying the cloth, as a coloring agent, wherein said ink has a coloring agent content in a range of 3.0 wt % to 10.0 wt %, and the cloth to be used has a bleeding ratio as printed by said ink in a range of 2.0 times to 4.0 times.

2. An integrated type pack as claimed in claim 1, wherein said ink contains dye and said printing media is cloth to be dyed by hydrogen bond or ionic bond with the acid dye or direct dye.

3. An integrated type pack as claimed in claim 1, wherein said ink contains acid dye or direct dye and said printing media is cloth to be dyed by hydrogen bond or ionic bond with the acid dye or direct dye.

4. An integrated type pack as claimed in claim 1, wherein said ink contains disperse dye and said printing media is cloth to be dyed by intermolecular bond with the disperse dye.

* * * * *

UNITED STATES PATENT AND TRADEMARK OFFICE

CERTIFICATE OF CORRECTION

PATENT NO. : 6,830,330 B2
DATED : December 14, 2004
INVENTOR(S) : Mariko Suzuki et al.

It is certified that error appears in the above-identified patent and that said Letters Patent is hereby corrected as shown below:

Title page,
Item [75], Inventors, "Hiroyuki Saito, Tokuo (JP);" should read -- Hiroyuki Saito, Machida (JP); --.

Column 2,
Line 66, "view pint" should read -- viewpoint --.

Column 4,
Line 63, "may-be" should read -- may be --.

Column 14,
Line 3, "ASFI." should read -- ASF1. --.

Column 17,
Line 57, "printing" should read -- printing. --.
Line 67, "tively" should read -- tively. --.

Column 19,
Lines 62 and 64, "disperce" should read -- disperse --.

Column 25,
Line 14, "centroronics" should read -- centronics --.

Column 34,
Lines 52, 56 and 60, "An integrated type pack" should read -- A media pack --.

Signed and Sealed this

Seventh Day of June, 2005

JON W. DUDAS
*Director of the United States Patent and Trademark Office*